US009145740B2

(12) United States Patent
Durairajan et al.

(10) Patent No.: US 9,145,740 B2
(45) Date of Patent: Sep. 29, 2015

(54) STABILIZING MEMBERS FOR FIXED CUTTER DRILL BIT

(71) Applicant: Smith International, Inc., Houston, TX (US)

(72) Inventors: Bala Durairajan, Sugar Land, TX (US); Dwayne P. Terracina, Spring, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 14/107,051

(22) Filed: Dec. 16, 2013

(65) Prior Publication Data

US 2014/0102798 A1 Apr. 17, 2014

Related U.S. Application Data

(62) Division of application No. 12/828,887, filed on Jul. 1, 2010, now Pat. No. 8,783,386.

(60) Provisional application No. 61/222,341, filed on Jul. 1, 2009.

(51) Int. Cl.
*E21B 10/43* (2006.01)
*E21B 10/55* (2006.01)

(52) U.S. Cl.
CPC ..... *E21B 10/43* (2013.01); *E21B 10/55* (2013.01)

(58) Field of Classification Search
CPC ..... E21B 10/55; E21B 12/04; E21B 10/5673; E21B 10/5676; E21B 10/43
See application file for complete search history.

(56) References Cited

U.S. PATENT DOCUMENTS

| | | | | |
|---|---|---|---|---|
| 4,718,505 | A | 1/1988 | Fuller | |
| 4,872,520 | A | 10/1989 | Nelson | |
| 4,991,670 | A | 2/1991 | Fuller et al. | |
| 5,186,268 | A | 2/1993 | Clegg | |
| 5,531,281 | A | 7/1996 | Murdock | |
| 5,595,252 | A | 1/1997 | O'Hanlon | |
| 6,408,958 | B1 | 6/2002 | Isbell et al. | |
| 6,460,631 | B2 | 10/2002 | Dykstra et al. | |
| 6,659,199 | B2 | 12/2003 | Swadi | |
| 2008/0179108 | A1 | 7/2008 | McClain et al. | |
| 2008/0264696 | A1 | 10/2008 | Dourfaye et al. | |
| 2008/0308321 | A1* | 12/2008 | Aliko et al. | 175/431 |
| 2010/0276200 | A1* | 11/2010 | Schwefe et al. | 175/57 |

OTHER PUBLICATIONS

International Search Report & Written Opinion issued in PCT/US2010/040783 on Feb. 9, 2011; 7 pages.
Examination Report issued in GB1122014.2 on Mar. 19, 2013, 2 pages.
Examination Report issued in GB1122014.2 on Jul. 18, 2013, 3 pages.
Combined Search and Examination Report issued in GB1316573.3 on Oct. 31, 2013, 4 pages.

* cited by examiner

*Primary Examiner* — David Andrews

(57) ABSTRACT

A drill bit for drilling a borehole in an earthen formation includes a first blade having a cutter-supporting surface. The cutting profiles of cutting faces of primary cutter elements mounted to the cutter-supporting surface define an outermost cutting profile $P_o$ in rotated profile view. A stabilizing member may be included, having an end distal the cutter-supporting surface including a tip. The tip may be offset from the outermost cutting profile $P_o$ in rotated profile view.

20 Claims, 16 Drawing Sheets

STABILIZING MEMBERS FOR FIXED CUTTER DRILL BIT

CROSS-REFERENCE TO RELATED APPLICATIONS

This application is a divisional application of U.S. application Ser. No. 12/828,887, filed on Jul. 1, 2010, which claims priority to and the benefit of U.S. Provisional Application No. 61/222,341, filed Jul. 1, 2009, the entire contents of both of which are hereby incorporated by reference.

BACKGROUND

1. Field of the Invention

The invention relates generally to earth-boring drill bits used to drill a borehole for the ultimate recovery of oil, gas, or minerals. More particularly, the invention relates to drag bits and to improved stabilizing features for such bits. Still more particularly, the present invention relates to arrangements of stabilizing members on drag bits that trail corresponding cutter elements on the bit and engage the ridge of uncut formation between radially adjacent cutter elements to enhance bit stability.

2. Background of the Invention

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Many different types of drill bits and cutting structures for bits have been developed and found useful in drilling such boreholes. Two predominate types of drill bits are roller cone bits and fixed cutter bits, also known as rotary drag bits. Some fixed cutter bit designs include primary blades, secondary blades, and sometimes even tertiary blades, angularly spaced about the bit face, where the primary blades are generally longer and start at locations closer to the bit's rotating axis. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PDC bit" or "PDC cutter element" refers to a fixed cutter bit or cutting element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is desirable to employ drill bits which will drill faster and longer, and which are usable over a wider range of formation hardness.

The length of time that a drill bit may be employed before it must be changed depends upon a variety of factors. These factors include the bit's rate of penetration ("ROP"), as well as its durability or ability to maintain a high or acceptable ROP.

Excessive wear of cutter elements and damage to cutter elements resulting from impact loads detrimentally impact bit ROP. Excessive wear and damage to cutter elements may arise for a variety of reasons. For example, in a soft formation layer, the cutter elements can often sustain a relatively large depth-of-cut (DOC) and associated high ROP. However, as the bit transitions from the soft formation layer to a hard formation layer, such a large depth-of-cut typically result in abrupt and unpredictable impact loads to the cutter elements, which increases the likelihood of excessive wear of the cutter elements, breakage/fracture of the cutter elements, and/or delamination of the cutter elements. As another example, instability and vibrations experienced by a downhole drill bit may result in undesirable impact loads to the cutter elements, which may chip, break, delaminate, and/or excessively wear the cutter elements. Such excessive wear and damage resulting from impact loads experienced by cutter elements typically results in a reduced ROP for a given weight-on-bit (WOB). Further, in many cases, such damage to the cutter elements is not recognized at the surface as the drilling rig attempts to further advance the bit into the formation with increased weight-on-bit (WOB), potentially damaging the bit beyond repair.

Bit balling and formation packing off can also detrimentally impact bit ROP. In particular, as formation is removed by cutter elements, drilling fluid from the bit's nozzles flushes the formation cuttings away from the bit face and up the annulus between the drill string and the borehole wall. As previously described, while drilling through soft formations the cutter elements can sustain a relatively high depth-of-cut and ROP, which results in a relatively high volume of formation cuttings. If the volume of formation cuttings is sufficiently large, the nozzles may not provide sufficient cleaning of the bit face, potentially leading to plugging of the nozzles and the junk slots between the blades by the formation cuttings (i.e., bit "balling"). In addition to bit balling, an excessive depth-of-cut may decrease the steerability of the drill bit, thereby reducing effective ROP in directional drilling applications. In particular, with a large depth-of-cut, the drill bit must be continuously steered to keep the bit on course to limit and/or prevent the bit from "straying" off course.

Accordingly, there remains a need in the art for a fixed cutter bit and cutting structure capable of enhancing bit stability, bit ROP, and bit durability. Such a fixed cutter bit would be particularly well received if it offered the potential to limit the depth-of-cut of the cutter elements to reduce the potential for abrupt impact loads and bit balling, while allowing for enhanced steerability.

BRIEF SUMMARY OF SOME OF THE PREFERRED EMBODIMENTS

These and other needs in the art are addressed in one embodiment by a drill bit for drilling a borehole in an earthen formation. In an embodiment, the bit comprises a bit body having a bit axis, a bit face, and a direction of rotation about the bit axis. The bit face includes a cone region, a shoulder region, and a gage region. In addition, the bit comprises a first blade having a cutter-supporting surface and extending radially along the bit face. Further, the bit comprises a plurality of primary cutter elements mounted to the cutter-supporting surface of the first blade. Each primary cutter element on the first blade is mounted in a different radial position relative to the bit axis in the cone region and the shoulder region, and each primary cutter element has a cutting face that is forward-facing relative to the direction of rotation. Each cutting face defines a cutting profile in rotated profile view. The cutting profiles of the plurality of cutting faces define an outermost cutting profile $P_o$ in rotated profile view. The cutting profile of each cutting face may include a profile angle line that bisects the cutting face and is perpendicular to the outermost cutting profile $P_o$ in rotated profile view. Still further, the bit comprises a first stabilizing member mounted to the cutter-supporting surface of the first blade. The first stabilizing member has a longitudinal axis and a concave end distal the cutter-supporting surface of the first blade. The concave end of the first stabilizing member includes a first formation-facing surface extending to a first tip distal the cutter-supporting surface and a second formation-facing surface extending to a second tip distal the cutter-supporting surface. The first tip and the second tip are each offset from the outermost cutting profile $P_o$ in rotated profile view.

These and other needs in the art are addressed in another embodiment by a method of drilling a borehole in an earthen formation. In an embodiment, the method comprises (a) providing a drill bit comprising a bit body having a bit axis, a bit face, and a direction of rotation about the bit axis. The drill bit also comprising a plurality of blades extending radially along the bit face, each blade including a cutter-supporting surface. Further, the drill bit comprises a plurality of cutter elements mounted to the cutter-supporting surface of each blade. Each cutter element has a cutting face that is forward-facing relative to the direction of rotation. Each cutting face defines a cutting profile in rotated profile view, and the plurality of cutting faces define a composite cutting profile in rotated profile view. The drill bit also comprises a first stabilizing member mounted to the cutter-supporting surface of at least one blade. The stabilizing member has a longitudinal axis and a concave end distal the cutter-supporting surface of the first blade. The concave end of the first stabilizing member includes a first formation-facing surface and a second-formation facing surface. In addition, the method comprises (b) engaging the formation with the drill bit after (a). Further, the method comprises (c) penetrating the formation with a first of the plurality of cutter elements and a second of the plurality of cutter elements to a depth-of-cut. Moreover, the method comprises (d) limiting the depth of cut with the stabilizing member.

These and other needs in the art are addressed in another embodiment by a drill bit for drilling a borehole in an earthen formation. In an embodiment, the bit comprises a bit body having a bit axis, a bit face, and a direction of rotation about the bit axis. The bit face includes a cone region, a shoulder region, and a gage region. In addition, the bit comprises a first blade having a cutter-supporting surface and extending radially along the bit face. Further, the bit comprises a plurality of primary cutter elements mounted to the cutter-supporting surface of the first blade. Each primary cutter element on the first blade is mounted in a different radial position relative to the bit axis in the cone region and the shoulder region. Each primary cutter element has a cutting face that is forward-facing relative to the direction of rotation. Each cutting face defines a cutting profile in rotated profile view. The cutting profiles of the plurality of cutting faces define an outermost cutting profile in rotated profile view, and wherein the cutting profile of each cutting face includes a profile angle line that bisects the cutting face and is perpendicular to the outermost cutting profile $P_o$ in rotated profile view. Still further, the bit comprises a first stabilizing member mounted to the cutter-supporting surface of the first blade. The first stabilizing member having a longitudinal axis and a convex end distal the cutter-supporting surface of the first blade. The first stabilizing member trails a first of the plurality of primary cutter elements mounted to the first blade relative to the direction of rotation. The first stabilizing member is completely eclipsed by the cutting profile of the first of the plurality of primary cutter elements in rotated profile view. The first stabilizing member is oriented at a non-zero tilt angle $\beta_1$ measured between the longitudinal axis of the first stabilizing member and the profile angle line of the cutting face of the first of the plurality of primary cutter elements in rotated profile view.

Thus, embodiments described herein comprise a combination of features and advantages intended to address various shortcomings associated with certain prior drill bits and methods of using the same. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings, wherein.

DETAILED DESCRIPTION OF SOME OF THE PREFERRED EMBODIMENTS

Figure 1:
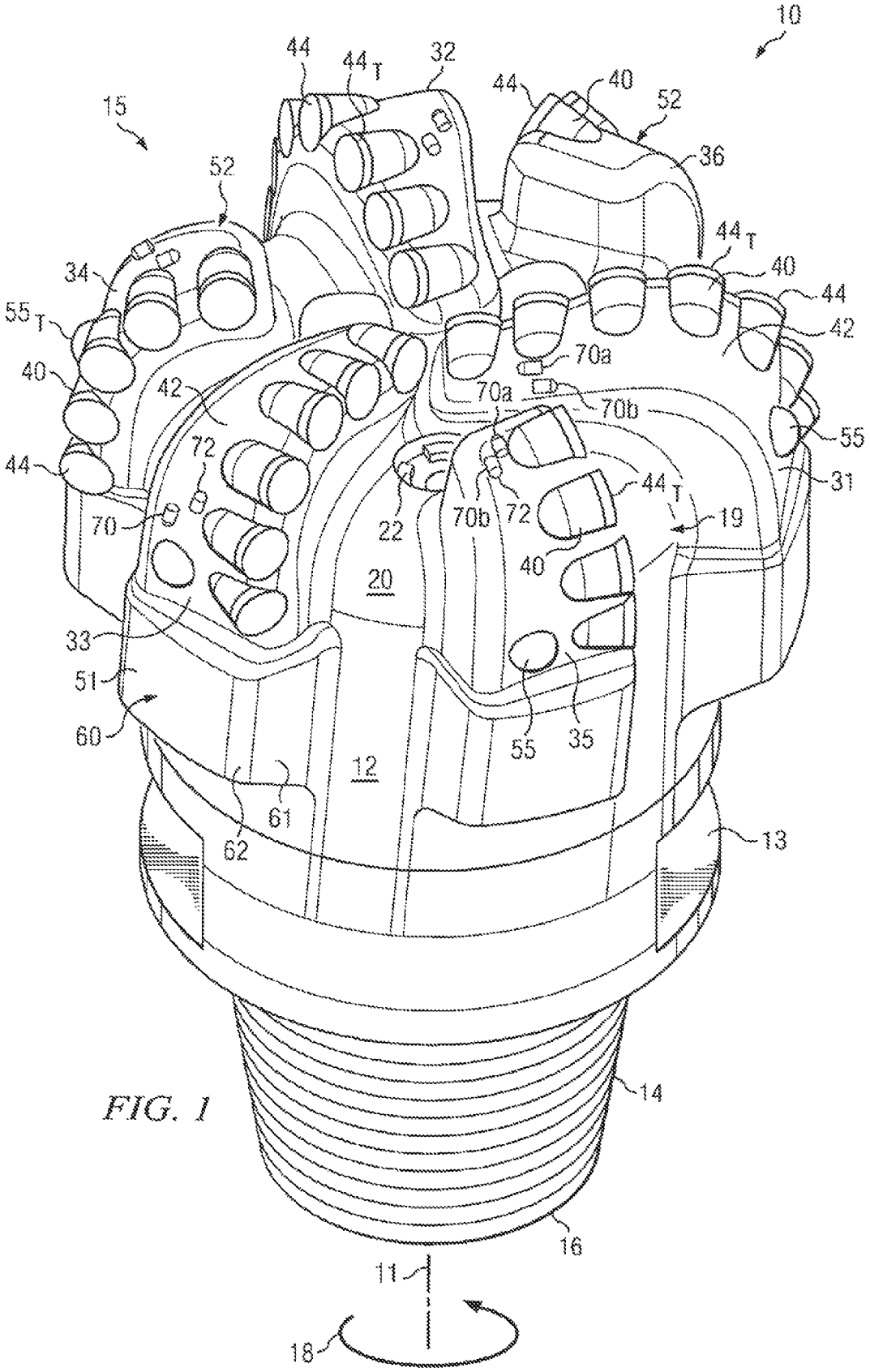
FIG. 1 is a perspective view of an embodiment of a bit made in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections.

Figure 2:
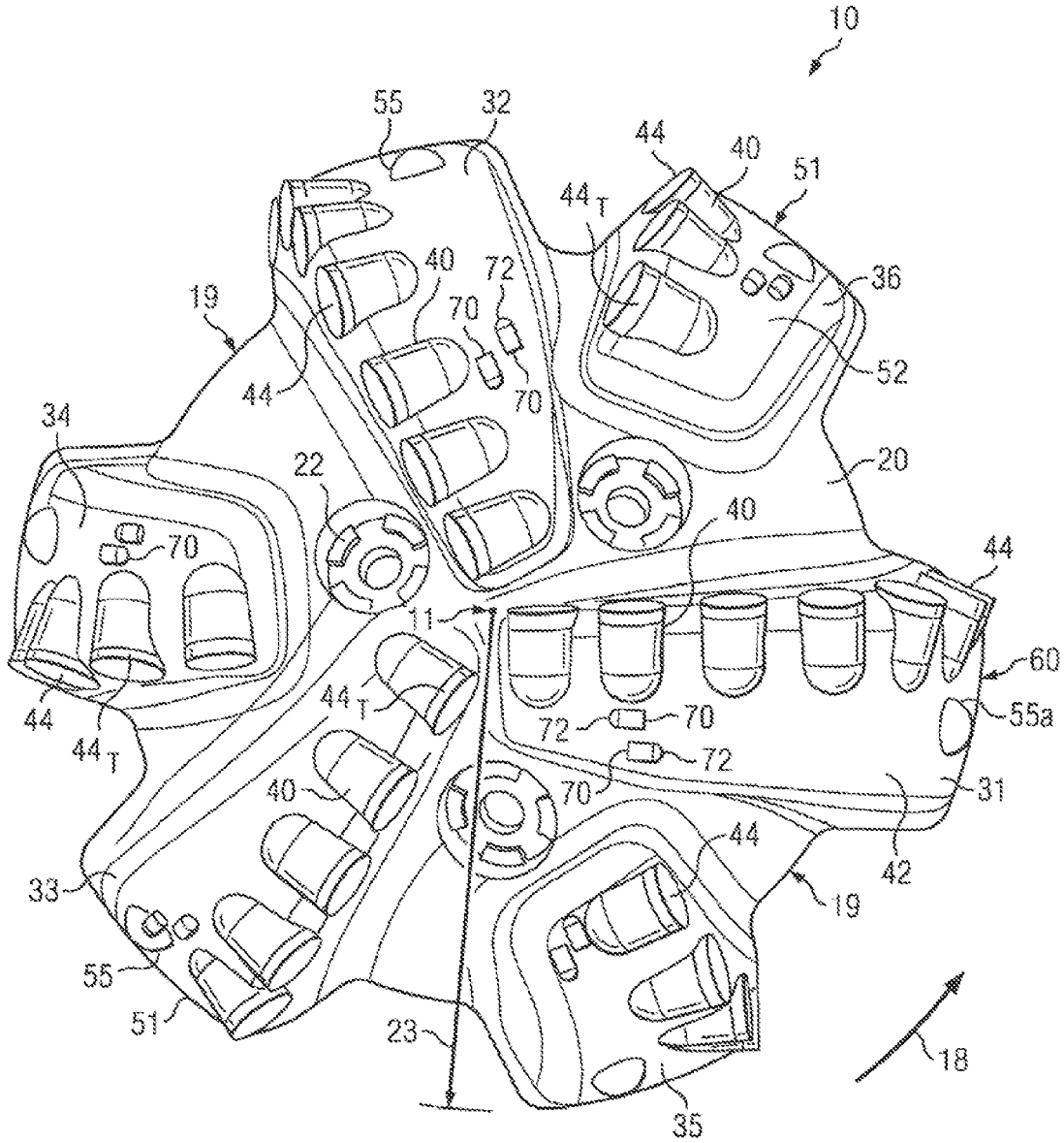
FIG. 2 is a top view of the bit shown in FIG. 1.

Referring to FIGS. 1 and 2, exemplary drill bit 10 is a fixed cutter bit, sometimes referred to as a drag bit, and is preferably a PDC bit adapted for drilling through formations of rock to form a borehole. Bit 10 generally includes a bit body 12, a shank 13 and a threaded connection or pin 14 for connecting bit 10 to a drill string (not shown), which is employed to rotate the bit in order to drill the borehole. Bit face 20 supports a cutting structure 15 and is formed on the end of the bit 10 that faces the formation and is generally opposite pin end 16. Bit 10 further includes a central axis 11 about which bit 10 rotates in the cutting direction represented by arrow 18. As used herein, the terms "axial" and "axially" generally mean along or parallel to the bit axis (e.g., bit axis 11), while the terms "radial" and "radially" generally mean perpendicular to the bit axis. For instance, an axial distance refers to a distance measured along or parallel to the bit axis, and a radial distance refers to a distance measured perpendicularly from the bit axis.

Body 12 may be formed in a conventional manner using powdered metal tungsten carbide particles in a binder material to form a hard metal cast matrix. Alternatively, the body can be machined from a metal block, such as steel, rather than being formed from a matrix.

Figure 4:
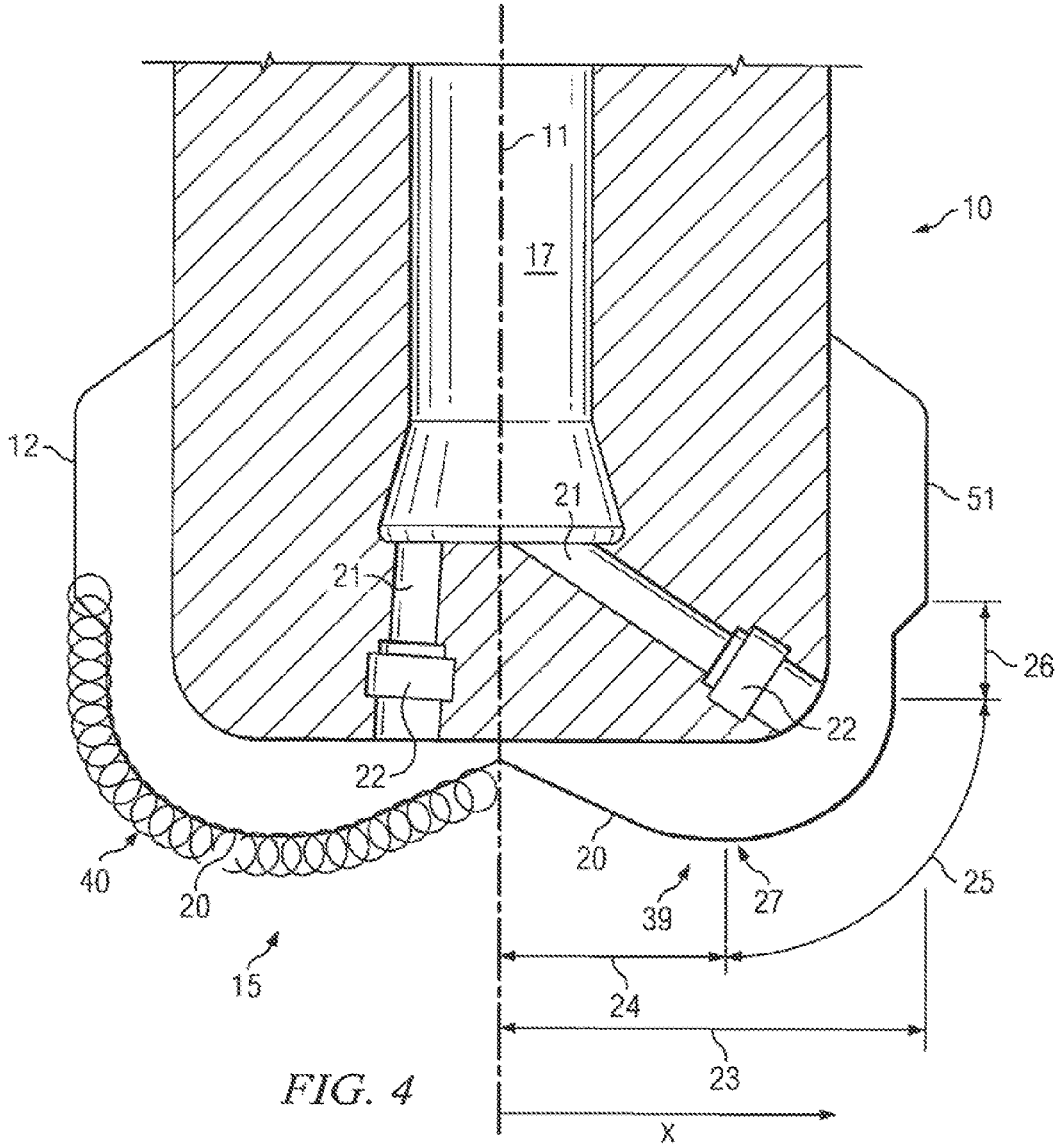
FIG. 4 is a partial cross-sectional view of the bit shown in FIG. 1 with the blades and the cutting faces of the cutter elements rotated into a single composite rotated profile.

As best seen in FIG. 4, body 12 includes a central longitudinal bore 17 permitting drilling fluid to flow from the drill string into bit 10. Body 12 is also provided with downwardly extending flow passages 21 having ports or nozzles 22 disposed at their lowermost ends. The flow passages 21 are in fluid communication with central bore 17. Together, passages 21 and nozzles 22 serve to distribute drilling fluids around cutting structure 15 to flush away formation cuttings during drilling and to remove heat from bit 10.

Referring again to FIGS. 1 and 2, cutting structure 15 is provided on face 20 of bit 10. Cutting structure 15 includes a plurality of blades which extend from bit face 20. In the embodiment illustrated in FIGS. 1 and 2, cutting structure 15 includes three primary blades 31, 32, 33 circumferentially spaced-apart about bit axis 11, and three secondary blades 34, 35, 36 circumferentially spaced apart about bit axis 11. In this embodiment, primary blades 31, 32, 33 and secondary blades 34, 35, 36 are circumferentially arranged in an alternating fashion. Thus, one secondary blade 34, 35, 36 is disposed between each pair of primary blades 31, 32, 33. Further, in this embodiment, the plurality of blades (e.g., primary blades 31, 32, 33 and secondary blades 34, 35, 36) are uniformly angularly spaced on bit face 20 about bit axis 11. In particular, the three primary blades 31, 32, 33 are uniformly angularly spaced about 120° apart, and the three secondary blades 34, 35, 36 are uniformly angularly spaced about 120° apart, and each primary blade 31, 32, 33 is angularly spaced about 60° from each circumferentially adjacent secondary blade 34, 35, 36. In other embodiments, one or more of the primary and/or secondary blades (e.g., blades 31-36) may be non-uniformly angularly spaced about the bit face (e.g., bit face 20). Moreover, although bit 10 is shown as having three primary blades 31, 32, 33 and three secondary blades 34, 35, 36, in general, bit 10 may comprise any suitable number of primary and secondary blades. As one example only, bit 10 may comprise two primary blades and four secondary blades.

Primary blades 31, 32, 33 and secondary blades 34, 35, 36 are integrally formed as part of, and extend from, bit body 12 and bit face 20. Further, primary blades 31, 32, 33 and secondary blades 34, 35, 36 extend generally radially along bit face 20 and then axially along a portion of the periphery of bit 10. Specifically, primary blades 31, 32, 33 extend radially from proximal bit axis 11 toward the radially outer periphery of bit 10. Thus, as used herein, the term "primary blade" refers to a blade that begins proximal the bit axis and extends generally radially outward along the bit face to the periphery of the bit. However, secondary blades 34, 35, 36 are not positioned proximal bit axis 11, but rather, begin at a location that is distal bit axis 11 and extend radially along bit face 20 toward the radially outer periphery of bit 10. Thus, as used herein, the term "secondary blade" refers to a blade that begins at some distance from the bit axis and extends generally radially along the bit face to the periphery of the bit. Primary blades 31, 32, 33 and secondary blades 34, 35, 36 are separated by drilling fluid flow courses 19.

Referring still to FIGS. 1 and 2, each primary blade 31, 32, 33 includes a cutter-supporting surface 42 for mounting a plurality of cutter elements, and each secondary blade 34, 35, 36 includes a cutter-supporting surface 52 for mounting a plurality of cutter elements. More specifically, a plurality of cutter elements 40, each having a cutting face 44, are mounted to cutter-supporting surface 42, 52 of each primary blade 31, 32, 33 and each secondary blade 34, 35, 36, respectively. Cutter elements 40 are arranged adjacent one another in a radially extending row proximal the leading edge of each primary blade 31, 32, 33 and each secondary blade 34, 35, 36, relative to the cutting direction of bit 10 represented by arrow 18, and thus, may also be referred to as "primary cutter elements." As used herein, the term "primary cutter element" refers to a cutter element that is not disposed behind and does not trail any other cutter elements on the same blade when the bit is rotated in the cutting direction about its axis, whereas the phrase "backup cutter element" refers to a cutter element that is disposed behind or trails another cutter element disposed on the same blade when the bit is rotated in the cutting direction about its axis. Each cutting face 44 has an outermost cutting tip $\mathbf{44}_T$ positioned furthest from cutter-supporting surface 42, 52 to which it is mounted (as measured perpendicularly from its respective cutter-supporting surface 42, 52).

Although primary cutter elements 40 are shown as being arranged in rows, they may be mounted in other suitable arrangements provided each cutter element is in a leading position on its respective blade relative to the cutting direction. Examples of suitable arrangements may include without limitation, rows, arrays or organized patterns, randomly, sinusoidal pattern, or combinations thereof. In other embodiments, additional rows of cutter elements (e.g., a second or backup row of cutter elements, a tertiary row of cutter elements, etc.) may be provided on one or more primary blade(s), secondary blades(s), or combinations thereof.

In this embodiment, cutter-supporting surfaces 42, 52 also support a plurality of depth-of-cut (DOC) limiter inserts 55. In particular, one depth-of-cut limiter insert 55 extends from cutter-supporting surfaces 42, 52 of each primary blade 31, 32, 33 and each secondary blade 34, 35, 36, respectively. In this embodiment, each depth-of-cut limiter insert 55 trails the row of cutter elements 40 provided on the same blade 31-36.

Each depth-of-cut limiter insert 55 is a generally cylindrical stud having a semi-spherical or dome-shaped end 55*a*. Each depth-of-cut limiter insert 55 is secured in a mating socket in its respective cutter-supporting surface 42, 52 with dome-shaped end 55*a* extending from cutter-supporting surface 42, 52. Depth-of-cut limiter inserts 55 are intended to limit the maximum depth-of-cut of cutting faces 44 as they engage the formation. In particular, dome-shaped ends 55*a* of depth-of-cut limiter inserts 55 are intended to slide across the formation and limit the depth to which cutting faces 44 bite or penetrate into the formation. Thus, unlike cutter elements (e.g., cutter elements 40), depth-of-cut limiter inserts 55 are not intended to penetrate and shear the formation. Although only one depth-of-cut limiter insert 55 is shown on each blade 31-36, in general, any suitable member of depth-of-cut limiters may be provided on one or more blades of bit 10. In some embodiments, no depth-of-cut limiters (e.g., depth-of-cut limiter inserts 55) are provided.

As used herein, the terms "leads," "leading," "trails," and "trailing" are used to described the relative positions of two structures (e.g., cutter element and stabilizing member) on the same blade relative to the direction of bit rotation. In particular, a first structure that is disposed ahead or in front of a second structure on the same blade relative to the direction of bit rotation "leads" the second structure (i.e., the first structure is in a "leading" position), whereas the second structure that is disposed behind the first structure on the same blade relative to the direction of bit rotation "trails" the first structure (i.e., the second structure is in a "trailing" position).

Referring still to FIGS. 1 and 2, bit 10 also comprises a plurality of stabilizing members 70 supported by cutter-supporting surfaces 42, 52. In this embodiment, a pair of stabilizing members 70 extend from cutter-supporting surfaces 42, 52 of each primary blade 31, 32, 33, and each secondary blade 34, 35, 36. Each pair of stabilizing members 70 on a given blade 31-36 trail the row of cutter elements provided on the same blade 31-36. In particular, in this embodiment, both stabilizing members 70 on each blade 31-36 are disposed circumferentially behind, and thus, trail the same cutter element 40 relative to the direction of bit rotation represented by arrow 18. Further, on each blade 31-36, a first of the pair of stabilizing members 70, referred to herein as first or leading stabilizing member 70*a*, leads a second of the pair of stabilizing members 70, referred to herein as second or trailing stabilizing member 70*b*, relative to the direction of bit rotation. Thus, on a given blade 31-36, first stabilizing member 70*a* immediately trails its corresponding cutter element 40, and second stabilizing member 70*b* trails both first stabilizing member 70*a* and the same corresponding cutter element 40. Although two stabilizing members 70*a, b* are provided on each blade 31-36 in this embodiment, in general, any suitable number of stabilizing members (e.g., stabilizing members 70) may be provided on one or more blades of the bit. For example, a given blade may include less than two (e.g., zero) or more than two (e.g., 4) stabilizing members in other embodiments.

Figure 3:
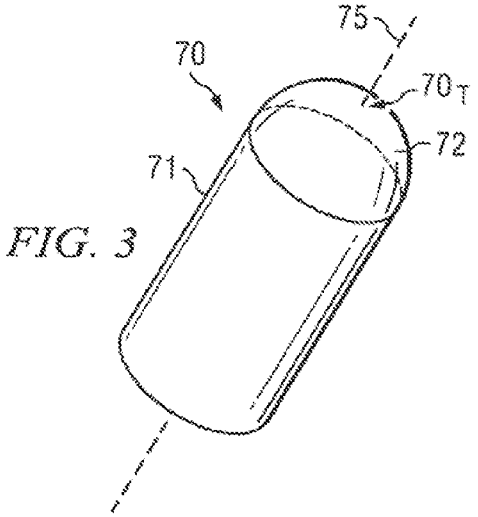
FIG. 3 is a perspective view of one of the stabilizing members of FIG. 1.

As best shown in FIG. 3, each stabilizing member 70 comprises a cylindrical body 71 having a central or longitudinal axis 75 and a convex formation-facing end 72. In this embodiment, convex end 72 is semi-spherical or dome-shaped, and thus, may also be referred to as dome-shaped end 72. In addition, each stabilizing member 70 includes a bearing tip $\mathbf{70}_T$ on dome-shaped end 72. In general, the bearing tip of a convex stabilizing member represents the point or portion on the surface of the formation-facing end of a convex stabilizing member that is furthest from the body of the stabilizing member as measured parallel to the longitudinal axis of the stabilizing member. Thus, bearing tip $\mathbf{70}_T$ represents the point or portion on the surface of formation-facing end 72 that is furthest from body 71 as measured parallel to longitudinal axis 75. In this embodiment, bearing tip $\mathbf{70}_T$ is intersected by central axis 75.

Referring again to FIGS. 1 and 2, in this embodiment, each stabilizing member 70 is an insert secured in a mating socket in its respective cutter-supporting surface 42, 52 with its dome-shaped end 72 distal cutter-supporting surface 42, 52 and adapted to engage the formation. As will be described in more detail below, stabilizing members 70 offer the potential to enhance bit stability, as well as limit the maximum depth-of-cut of cutting faces 44 as they engage the formation. In particular, dome-shaped ends 72 of each pair of stabilizing members 70 are intended to bear against the uncut formation and slide across the ridges of uncut formation on opposite sides of the kerf created by cutting face 44 of their corresponding cutter element 40. Consequently, dome-shaped ends 72 may also be referred to as bearing ends 72. Unlike cutter elements (e.g., cutter elements 40), stabilizing members 70 are not intended to penetrate and shear the formation. As previously described, in this embodiment, stabilizing members 70 are inserts manufactured separate from bit body 12 and secured via interference fit within a mating socket on blades 31-36. However, in general, one or more of the stabilizing members (e.g., stabilizing members 70) may be formed integral with the bit body (e.g., bit body 12). For example, in other embodiments, one or more of the stabilizing members may be integral with and formed from the same material as the blade to which it is mounted.

Stabilizing members 70 preferably comprises a hard support member made of tungsten carbide and an abrasion resistant layer on bearing end 72. Suitable material for the abrasion resistant layer include polycrystalline diamond or other superabrasive material such as cubic boron nitride, thermally stable diamond, polycrystalline cubic boron nitride, or ultra-hard tungsten carbide (meaning a tungsten carbide material having a wear-resistance that is greater than the wear-resistance of the material forming the substrate) as well as mixtures or combinations of these materials.

Referring still to FIGS. 1 and 2, bit 10 further includes gage pads 51 of substantially equal axial length measured generally parallel to bit axis 11. Gage pads 51 are circumferentially spaced about the outer periphery of bit 10. Specifically, one gage pad 51 intersects and extends from each blade 31-36. In this embodiment, gage pads 51 are integrally formed as part of the bit body 12.

As best shown in FIG. 1, each gage pad 51 includes a generally gage-facing surface 60 and a generally forward-facing surface 61 which intersect in an edge 62, which may be radiused, beveled or otherwise rounded. Gage-facing surface 60 includes at least a portion that extends in a direction generally parallel to bit access 11 and extends to full gage diameter. In some embodiments, other portions of the gage-facing surface (e.g., gage-facing surface 60) may be angled, and thus slant away from the borehole sidewall. The forward-facing surface (e.g., forward-facing surface 61) may likewise be angled relative to central axis 11 (both as viewed perpendicular to central axis 11 or as viewed along bit axis 11). Surface 61 is termed generally "forward-facing" to distinguish that surface from the gage-facing surface 60, which generally faces the borehole sidewall. Gage-facing surface 60 of gage pads 51 abut the borehole sidewall during drilling. The gage pads can help maintain the size of the borehole by a rubbing action when cutter elements 40 wear slightly under gage. Gage pads 51 also help stabilize bit 10 against vibration. In other embodiments, one or more of the gage pads (e.g., gage pads 51) may include other structural features including, without limitation, wear-resistant cutter elements or inserts may be embedded in gage pads and protrude from the gage-facing surface or forward-facing surface.

Referring now to FIG. 4, an exemplary profile of bit 10 is shown as it would appear with all blades 31-36 and associated cutter elements 40 rotated into a single rotated profile. For purposes of clarity, the rotated profile of depth-of-cut limiter inserts 55 are not shown in this view.

In rotated profile view, blades 31-36 of bit 10 form a combined or composite blade profile 39 generally defined by cutter-supporting surfaces 42, 52 of each blade 31-36. In this embodiment, cutter-supporting surface 42, 52 of each blade 31-36 is coincident with, and extends along at least a portion of composite blade profile 39. Composite blade profile 39 and bit face 20 may generally be divided into three regions conventionally labeled cone region 24, should region 25, and gage region 26. Cone region 24 comprises the radially innermost region of bit 10 and composite blade profile 39 extending generally from bit axis 11 to should region 25. In this embodiment, cone region 24 is generally concave. Adjacent cone region 24 is shoulder (or the upturned curve) region 25. In this embodiment, shoulder region 25 is generally convex. The transition between cone region 24 and shoulder region 25, typically referred to as the nose or nose region 27, occurs at the axially outermost portion of composite blade profile 39 where a tangent line to the blade profile 39 has a slope of zero. Moving radially outward, adjacent shoulder region 25 is gage region 26, which extends substantially parallel to bit axis 11 at the radially outer periphery of composite blade profile 39. As shown in composite blade profile 39, gage pads 51 define the outer radius 23 of bit 10. Outer radius 23 extends to and therefore defines the full gage diameter of bit 10. As used herein, the term "full gage diameter" refers to the outer diameter of the bit defined by the radially outermost reaches of the cutter elements and surfaces of the bit.

Still referring to FIG. 4, cone region 24, shoulder region 25, and gage region 26 may also be defined by a radial distance measured from, and perpendicular to, bit axis 11. The radial distance defining the bounds of cone region 24, shoulder region 25, and gage region 26 may be expressed as a percentage of outer radius 23. In the embodiment shown in FIG. 4, cone region 24 extends from central axis 11 to about 40% of outer radius 23, shoulder region extends from cone region 24 to about 90% of outer radius 23, and gage region extends from shoulder region 25 to outer radius 23. Cone region 24 may also be defined by the radially innermost end of one or more secondary blades (e.g., secondary blades 34, 35, 36). In other words, the cone region (e.g., cone region 24) extends from the bit axis to the radially innermost end of one or more secondary blade(s). It should be appreciated that the actual radius of the cone region of a bit measured from the bit's axis may vary from bit to bit depending on a variety of factors including without limitation, bit geometry, bit type, location of one or more secondary blades, location of cutter elements, or combinations thereof. For instance, in some cases the bit (e.g., bit 10) may have a relatively flat parabolic profile resulting in a cone region (e.g., cone region 24) that is relatively large (e.g., 50% of the outer radius). However, in other cases, the bit may have a relatively long parabolic profile resulting in a relatively smaller cone region (e.g., 30% of the outer radius).

Figure 5:
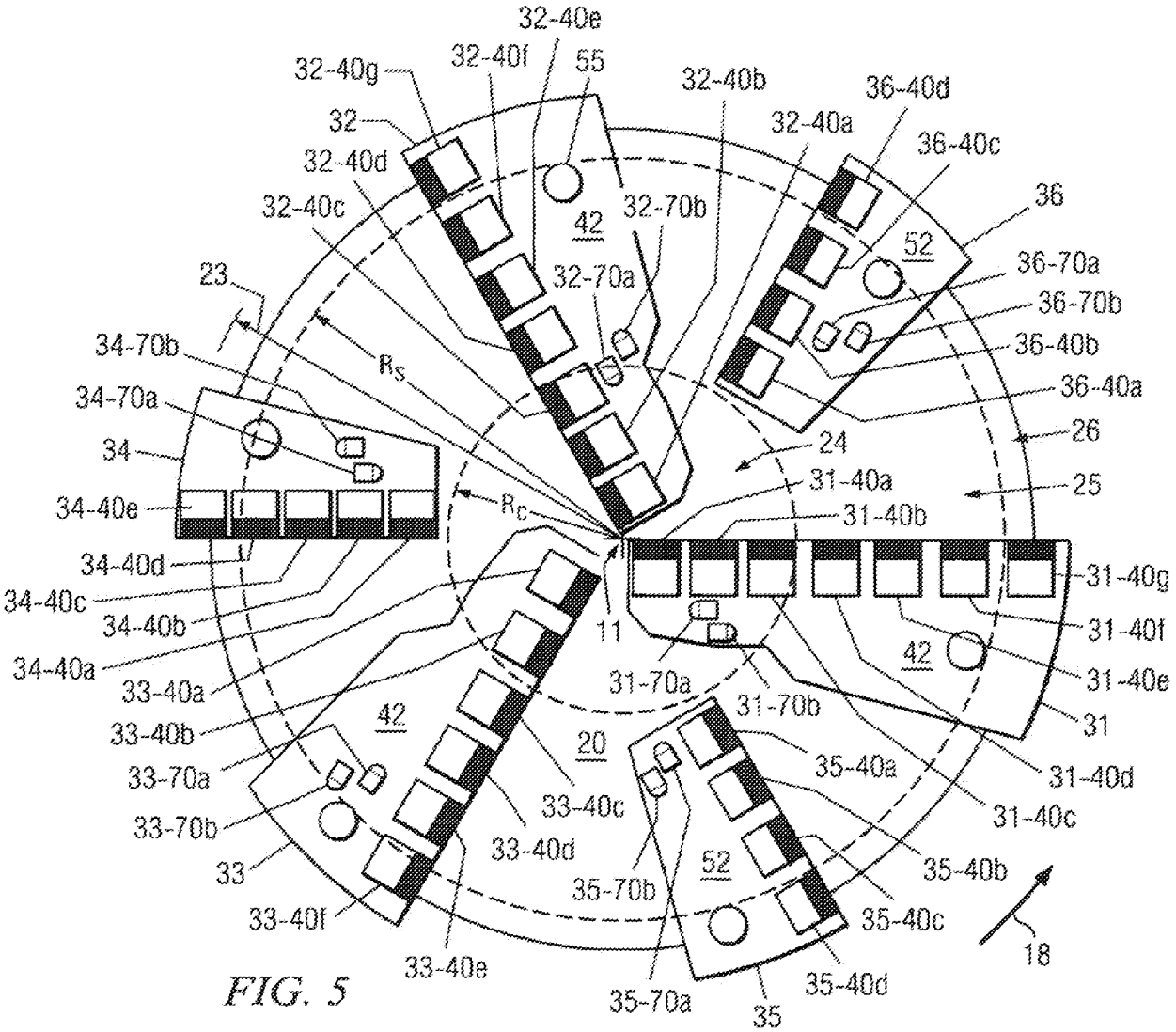
FIG. 5 is a schematic top view of the bit shown in FIG. 1.

Referring now to FIG. 5, a schematic top view of bit 10 is illustrated. For purposes of clarity, nozzles 22 are not shown in this view. Moving radially outward from bit axis 11, bit face 20 includes cone region 24, shoulder region 25, and gage region 26 as previously described. Nose region 27 generally represents the transition between cone region 24 and shoulder region 25. Specifically, cone region 24 extends radially from bit axis 11 to a cone radius $R_c$, shoulder region 25 extends radially from cone radius $R_c$ to shoulder radius $R_s$, and gage region 26 extends radially from shoulder radius $R_s$ to bit outer radius 23.

Primary blades 31, 32, 33 extend radially along bit face 20 from within cone region 24 proximal bit axis 11 toward gage region 26 and outer radius 23. Secondary blades 34, 35, 36 extend radially along bit face 20 from proximal nose region 27 toward gage region 26 and outer radius 23. In this embodiment, secondary blades 34, 35, 36 do not extend into cone region 24, and thus, secondary blades 34, 35, 36 occupy no space on bit face 20 within cone region 24. In other embodiments, the secondary blades (e.g., secondary blades 34, 35, 36) may extend to and/or slightly into the cone region (e.g., cone region 24). In this embodiment, each primary blade 31, 32, 33 and each secondary blade 34, 35, 36 extends substantially to gage region 26 and outer radius 23. However, in other embodiments, one or more primary and/or secondary blades may not extend completely to the gage region or outer radius of the bit.

Referring still to FIG. 5, primary blades 31, 32, 33 and secondary blades 34, 35, 36 provide cutter-supporting surfaces 42, 52, respectively, for mounting cutter elements 40, depth-of-cut limiter inserts 55, and stabilizing members 70 as previously described. In this embodiment, seven cutter elements 40 arranged in a row are provided on primary blade 31; seven cutter elements 40 arranged in a row are provided on primary blade 32; and six cutter elements 40 arranged in a row are provided on primary blade 33. Further, five cutter elements 40 arranged in a row are provided on secondary blade 34; four cutter elements 40 arranged in a row are provided on secondary blade 35; and four cutter elements 40 arranged in a row are provided on secondary blade 36. In other embodiments, the number of cutter elements (e.g., cutter elements 40) on each primary blade (e.g., primary blades 31, 32, 33) and each secondary blade (e.g., secondary blades 34, 35, 36) may vary.

Referring now to FIGS. 1, 2, and 5, each cutter element 40 comprises an elongated and generally cylindrical support member or substrate which is received and secured in a mating pocket formed in the surface of the blade to which it is fixed. In general, each cutter element may have any suitable size and geometry. In this embodiment, each cutter element 40 has substantially the same size and geometry, however, in other embodiments, one or more cutter elements (e.g., cutter element 40) may have a different size and/or geometry.

Cutting face 44 of each cutter element 40 comprises a disk or tablet-shaped, hard cutting layer of polycrystalline diamond or other superabrasive material that is bonded to the exposed end of the support member. In the embodiments described herein, each cutter element (e.g., cutter element 40) is mounted such that its cutting face (e.g., cutting face 44) is generally forward-facing. As used herein, "forward-facing" refers to the orientation of a surface that is substantially perpendicular to, or at an acute angle relative to, the cutting direction of the bit (e.g., cutting direction 18 of bit 10). For instance, a forward-facing cutting face (e.g., cutting face 44) may be oriented perpendicular to the cutting direction of bit 10, may include a backrake angle, and/or may include a siderake angle. However, the cutting faces are preferably oriented perpendicular to the direction of rotation of bit 10 plus or minus a 45° backrake angle and plus or minus a 45° siderake angle. In addition, each cutting face 44 includes a cutting edge adapted to positively engage, penetrate, and remove formation material with a shearing action, as opposed to the grinding action utilized by impregnated bits to remove formation material. The cutting edge of each cutting face 44 may be chamfered or beveled as desired. In this embodiment, cutting faces 44 are substantially planar, but may be convex or concave in other embodiments. Each cutting face 44 preferably extends to or within 0.080 in. (~2.032 mm) of the outermost cutting profile of bit 10, and more preferably within 0.040 in. (~2.032 mm) of the outermost cutting profile of bit 10 as will be explained in more detail below.

Still referring to the embodiment shown in FIGS. 1, 2, and 5, each primary blade 31, 32, 33 and each secondary blade 34, 35, 36 generally tapers (e.g., becomes thinner) in top view as it extends radially inwards towards central axis 11. Consequently, primary blades 31, 32, 33 are relatively thin proximal axis 11 where space is generally limited circumferentially, and widen towards gage region 26. Although primary blades 31, 32, 33 and secondary blades 34, 35, 36 extend linearly in the radial direction in top view, in other embodiments, one or more of the primary blades, one or more secondary blades, or combinations thereof may be arcuate or curve along their length in top view.

As one skilled in the art will appreciate, numerous variations in the size, orientation, and locations of the blades (e.g., primary blades 31, 32, 33, secondary blades, 34, 35, 36, etc.), cutter elements (e.g., cutter elements 40), and the depth-of-cut limiter inserts (e.g., depth-of-cut limiter inserts 55) are possible.

Referring again to FIG. 5, for purposes of clarity and further explanation, cutter elements 40 mounted to primary blade 31 are assigned reference numerals 31-40*a-g*, there being seven cutter elements 40 mounted to primary blade 31; cutter elements 40 mounted to primary blade 32 are assigned reference numerals 32-40*a-g*, there being seven cutter elements 40 mounted to primary blade 32; and cutter elements 40 mounted to primary blade 33 are assigned reference numerals 33-40*a-f*, there being six cutter elements 40 mounted to primary blade 33. Likewise, cutter elements 40 mounted to secondary blade 34 are assigned reference numerals 34-40*a-e*, there being five cutter elements 40 mounted to secondary blade 34; cutter elements 40 mounted to secondary blade 35 are assigned reference numerals 35-40*a-d*, there being four cutter elements 40 mounted to secondary blade 35; and cutter elements 40 mounted to secondary blade 36 are assigned reference numerals 36-40*a-d*, there being four cutter elements 40 mounted to secondary blade 36. Moreover, stabilizing members 70*a, b* on blades 31-36 are assigned reference numerals 31-70*a, b*; 32-70*a, b*; 33-70*a, b*; 34-70*a, b*; 35-70*a, b*; and 36-70*a, b*, respectively.

As previously described, on each blade 31-36, first or leading stabilizing member 70*a* immediately trails its corresponding cutter element 40, and second or trailing stabilizing member 70*b* trails both its corresponding cutter element 40 and first stabilizing member 70*a*. Specifically, on blade 31, first stabilizing member 31-70*a* immediately trails cutter element 31-40*b*, and second stabilizing member 31-70*b* immediately trails first stabilizing member 31-70*a;* on blade 32, first stabilizing member 32-70*a* trails cutter element 32-40*c*, and second stabilizing member 32-70*b* trails first stabilizing member 32-70*a;* on blade 33, first stabilizing member 33-70*a* trails cutter element 33-40*e*, and second stabilizing member 33-70*b* trails first stabilizing member 33-70*a;* on blade 34, first stabilizing member 34-70*a* trails cutter element 34-40*b*, and second stabilizing member 34-70*b* trails first stabilizing member 34-70*a;* on blade 35, first stabilizing member 35-70*a* trails cutter element 35-40*a*, and second stabilizing member 35-70*b* trails first stabilizing member 35-70*a;* and on blade 36, first stabilizing member 36-70*a* trails cutter element 36-40*b*, and second stabilizing member 36-70*b* trails first stabilizing member 36-70*a*.

During drilling operations, a majority of weight-on-bit (WOB) is transferred to the cutter elements disposed in the cone and shoulder regions. Further, as the nose of the bit generally leads the bit as it progresses through the formation, the cutter elements at the nose and proximal the nose in the cone region and the shoulder region typically experience the greatest impact loads resulting from transitions from soft to harder formation layers. Consequently, the stabilizing members (e.g., stabilizing members 70), designed to enhance bit stability and control depth-of-cut to reduce impact loads to cutter elements, are preferably positioned in the cone and shoulder regions of the bit to limit the "bite," and thereby protect, the cutter elements mounted therein. In this embodiment, cutter elements 31-40*a-c*, 32-40*a-c*, 33-40*a, b*, and stabilizing members 31-70*a, b* are disposed in cone region 24; cutter elements 31-40*d-f*, 32-40*d-f*, 33-40*c-e*, 34-40*a-d*, 35-40*a-c*, 36-40*a-c*, and stabilizing members 33-70*a, b*, 34-70*a, b*, 35-70*a, b*, 36-70*a, b* are disposed in shoulder region 25; and cutter elements 31-40*g*, 32-40*g*, 33-40*f*, 34-40*e*, 35-40*d*, 36-40*d* are disposed in gage region 26. Stabilizing members 32-70*a, b* are disposed at nose 27, generally at the transition from cone region 24 to shoulder region 25. In this embodiment, no stabilizing members are disposed in gage region 26.

Referring still to FIG. 5, in this embodiment, each depth-of-cut limiter insert 55 previously described is disposed in shoulder region 25 or gage region 26. In particular, each depth-of-cut limiter insert 55 is disposed at the same radial position as a cutter element 40 on the same blade. Thus, depth-of-cut limiter insert 55 on blade 31, 32, 33, 34, 35, 36 is disposed at the same radial position as cutter element 31-40*f*, 32-40*f*, 33-40*f*, 34-40*d*, 35-40*d*, , 36-40*c*, respectively.

Figure 6:
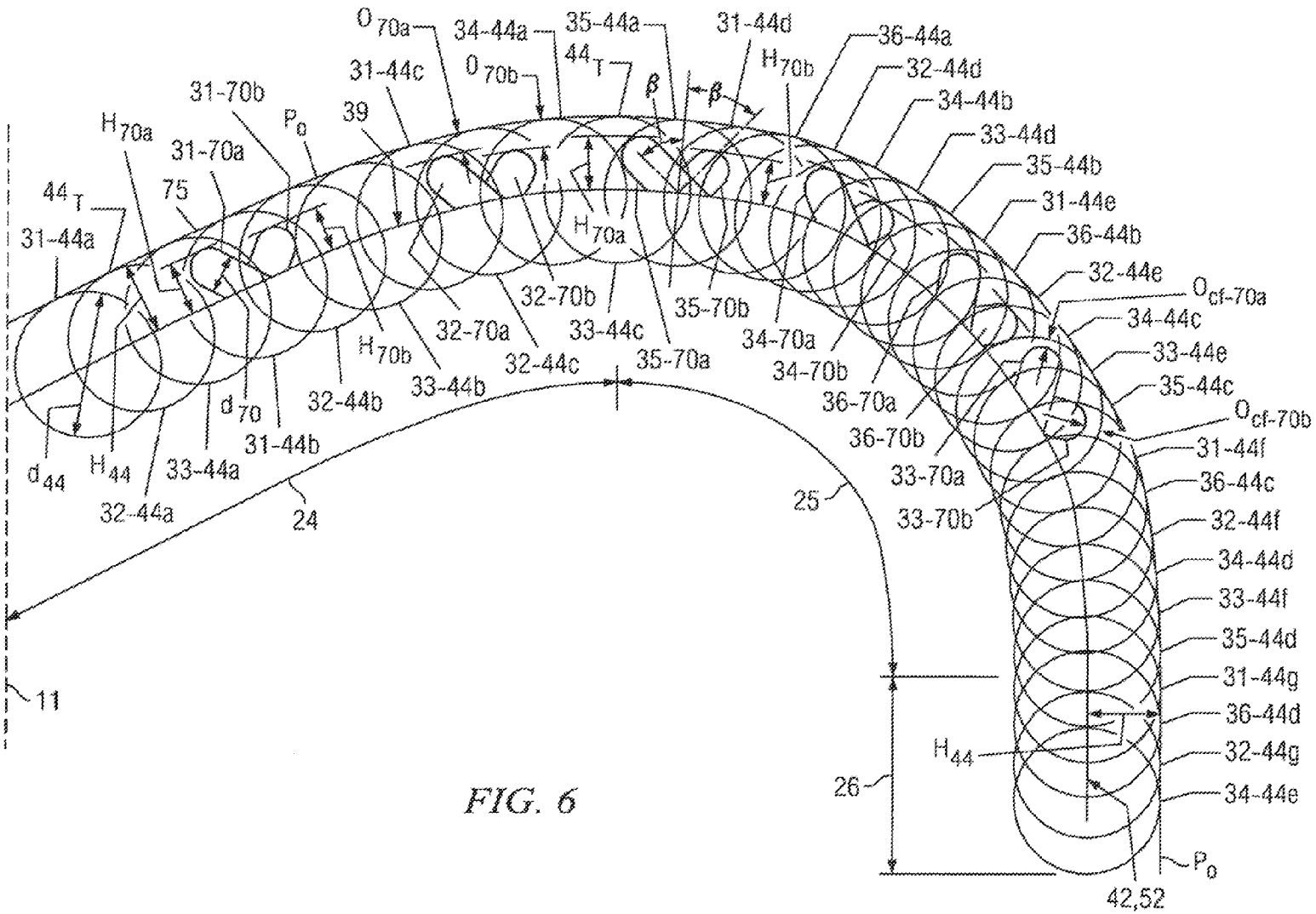
FIG. 6 is an enlarged view of the composite rotated profile of FIG. 3.

Referring now to FIG. 6, the profiles of primary blades 31, 32, 33, secondary blades 34, 35, 36, cutting faces 44, and stabilizing members 70 are schematically shown rotated into a single composite rotated profile view. It should be appreciated that the profiles of depth-of-cut limiter inserts 55 are not shown in this view. For purposes of clarity and further explanation, cutting faces 44 of cutter elements 31-40*a-g*, 32-40*a-g*, 33-40*a-f* of primary blades 31, 32, 33, respectively, are assigned reference numerals 31-44*a-g*, 32-44*a-g*, 33-44*a-f*, respectively. Likewise, cutting faces 44 of cutter elements 34-40*a-e*, 35-40*a-d*, 36-40*a-d* mounted to secondary blades 34, 35, 36, respectively, are assigned reference numerals 34-44*a-e*, 35-44*a-d*, 36-44*a-d*, respectively.

In rotated profile view, each primary blade 31, 32, 33 and each secondary blades 34, 35, 36 forms a blade profile generally defined by its cutter-supporting surface 42, 52. In this embodiment, the profiles of each primary blade 31, 32, 33 and each secondary blade 34, 35, 36 are each generally coincident with each other, thereby forming a single composite blade profile 39 previously described with reference to FIG. 4.

Referring still to FIG. 6, in this embodiment, each cutting face 44 (i.e., each cutting face 31-44*a-g*, 32-44*a-g*, 33-44*a-f*, 34-44*a-e*, 35-44*a-d*, 36-44*a-d*) extends to substantially the same extension height $H_{44}$ measured perpendicularly from cutter-supporting surfaces 42, 52 (or blade profile 39). As used herein, the phrase "extension height" refers to the distance or height to which a structure (e.g., cutting face, stabilizing member, etc.) extends perpendicularly from the cutter-supporting surface (e.g., cutter-supporting surface 42, 52) of the blade to which it is attached. Cutting tips $\mathbf{44}_T$ of cutting faces 44 are each disposed at extension height $H_{44}$ and define an outermost cutting profile $P_o$ that extends radially from bit axis 11 to outer radius 23. In this embodiment, outermost cutting profile $P_o$ is generally parallel to blade profile 39. In general, a curve passing through each cutting tip $\mathbf{44}_T$ that is not eclipsed or covered by another cutting face 44 in rotated profile view represents outermost composite cutting profile $P_o$. As shown in FIG. 6, no cutting tip $\mathbf{44}_T$ is eclipsed or covered by another cutting face 44 in rotated profile view, and thus, each cutting tip $\mathbf{44}_T$ lies along outermost cutting profile $P_o$. However, in other embodiments, the cutting tip(s) of one or more select cutter elements may be eclipsed or covered by another cutting face in rotated profile view. Such cutting tips that are eclipsed or covered by the cutting faces of different cutter elements in rotated profile view do not extend to, and do not define the outermost composite cutting profile. Thus, as used herein, the phrase "outermost composite cutting profile" refers to the curve or profile defined by the cutter element outermost cutting tips that are not covered or eclipsed by the cutting face of another cutter element in rotated profile view. It should be appreciated that the outermost composite cutting profile generally extends radially from the bit axis to the outer radius of the bit.

Figure 10:
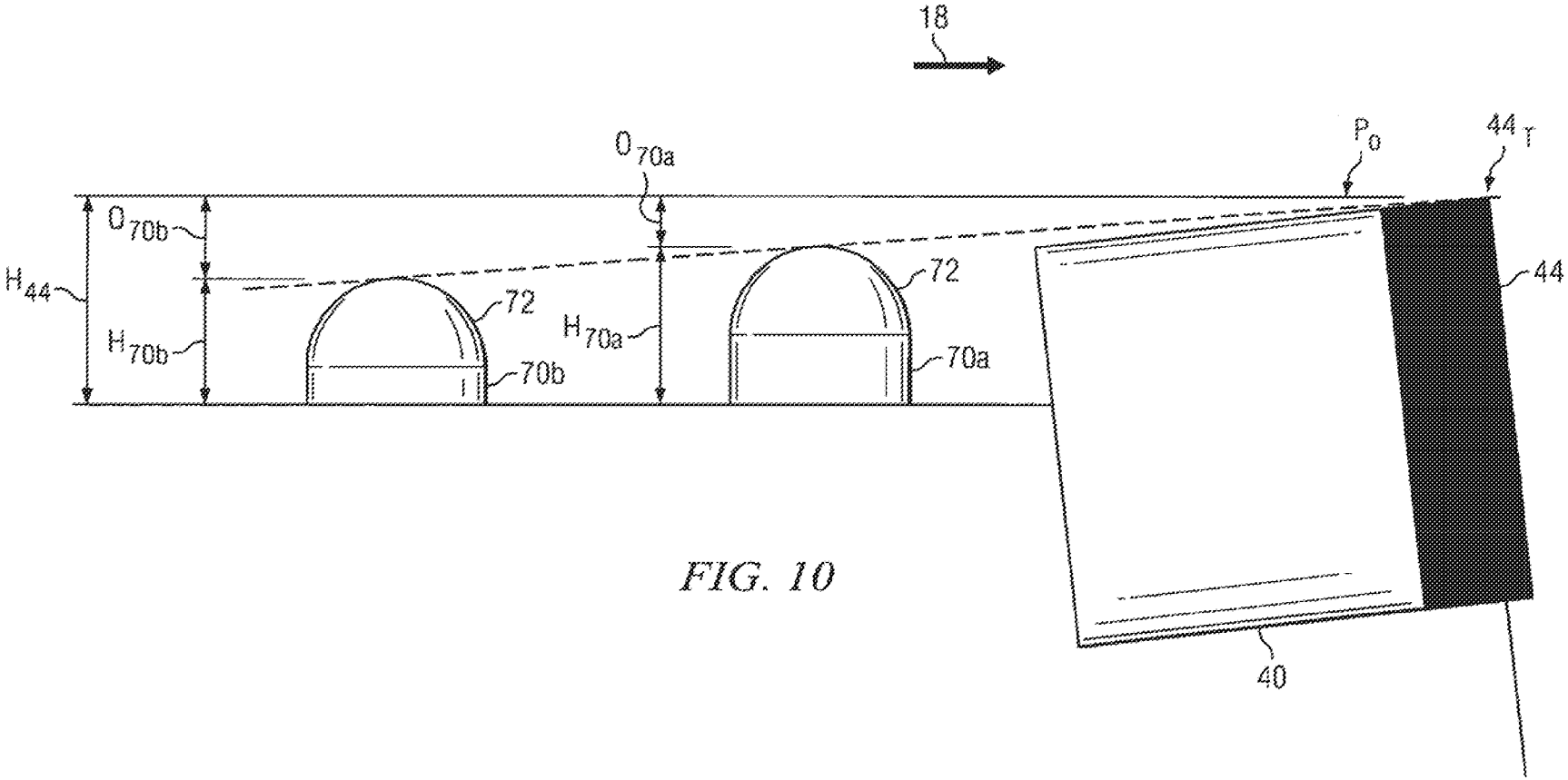
FIG. 10 is a schematic side view of one of the cutting elements and associated stabilizing members of FIG. 6.

Referring now to FIGS. 6 and 10, each leading stabilizing member 70*a* extends to substantially the same extension height $H_{70a}$ that is less than extension height $H_{44}$, and each trailing stabilizing member 70*b* extends to substantially the same extension height $H_{70b}$ that is less than both extension height $H_{70a}$ and extension height $H_{44}$. Thus, in this embodiment, extension height $H_{70a}$ of each leading stabilizing member 70*a* is greater than extension height $H_{70b}$ of each trailing stabilizing member 70*b*.

In this embodiment, stabilizing members 70*a, b* do not extend to outermost composite cutting profile $P_o$, and thus, may be described as being offset or "off profile" relative to outermost composite cutting profile $P_o$. As used herein, the phrase "off profile" refers to a structure extending from the cutter-supporting surface (e.g., cutter element, stabilizing member, etc.) that does not extend to the outermost composite cutting profile (e.g., outermost composite cutting profile $P_o$) in rotated profile view, whereas, the phrase "on profile" refers to structure (e.g., cutter element, stabilizing member, etc.) that extends from the cutter-supporting surface to the outermost composite cutting profile in rotated profile view. The degree or amount of offset relative to outermost composite cutting profile $P_o$ of each stabilizing member 70 may be characterized by a "composite cutting profile offset distance." As used herein, the phrase "composite cutting profile offset distance" refers to the minimum or shortest distance between the bearing end (e.g., bearing end 72) of a particular stabilizing member (e.g., stabilizing member 70) and the outermost composite cutting profile (e.g., outermost composite cutting profile $P_o$) in rotated profile view. As best shown in FIG. 6, each leading stabilizing member 70*a* has a composite cutting profile offset distance $O_{70a}$ equal to the shortest distance between its bearing end 72 and outermost composite cutting profile $P_o$. In this embodiment, composite cutting profile offset distance $O_{70a}$ is equal to the difference between extension height $H_{44}$ and extension height $H_{70a}$. Likewise, each trailing stabilizing member 70*b* has a composite cutting profile offset distance $O_{70b}$ equal to the shortest distance between its bearing end 72 and outermost composite cutting profile $P_o$. In this embodiment, composite cutting profile offset distance $O_{70b}$ is equal to the difference between extension height $H_{44}$ and extension height $H_{70b}$. Composite cutting profile offset distance $O_{70a}$ is preferably between 0.020 in. (~0.508 mm) and 0.100 in. (~2.54 mm), and more preferably between 0.040 in. (~1.016 mm) and 0.060 in. (~1.524 mm). Composite cutting profile offset distance $O_{70b}$ is preferably between 0.020 in. (~0.508 mm) and 0.100 in. (~2.54 mm), and more preferably between 0.040 in. (~1.016 mm) and 0.060 in. (~1.524 mm). In this embodiment, since extension height $H_{70a}$ of each leading stabilizing member 70*a* is greater than extension height $H_{70b}$ of each trailing stabilizing member 70*b*, composite cutting profile offset distance $O_{70b}$ is greater than composite cutting profile offset distance $O_{70a}$.

Referring still to FIG. 6, in this embodiment, each cutter element 40 has substantially the same cylindrical geometry and size as previously described. Consequently, each cutting face 44 has substantially the same diameter $d_{44}$. For an exemplary bit 10 having an overall gage diameter of 7.875 in. (~20 cm), diameter d of each cutting face 44 is about 0.625 in. (~16 mm). Further, in this embodiment, each stabilizing member 70 has substantially the same cylindrical geometry with a dome-shaped end. Consequently, each stabilizing member has substantially the same diameter $d_{70}$ with a dome-shaped end 72. For most applications and bit sizes, stabilizing members 70 preferably have a diameter between about 0.433 in. (~11 mm) and about 0.748 in. (~19 mm), and more preferably between about 0.512 in. (~13 mm) and about 0.63 in. (~16 mm). In other embodiments, the geometry and/or size of one or more cutting face and/or one or more stabilizing members may be different.

As a result of the relative sizes and radial positions cutting faces 44, and stabilizing members 70*a, b*, each pair of stabilizing members 70*a, b* on each blade 31-36 is completely eclipsed by its corresponding cutting face 44 in rotated profile view. For example, stabilizing members 31-70*a, b* are completely eclipsed by corresponding cutting face 31-44*b;* stabilizing members 32-70*a, b* are completely eclipsed by corresponding cutting face 32-44*c;* stabilizing members 33-70*a, b* are completely eclipsed by corresponding cutting face 33-44*e;* stabilizing members 34-70*a, b* are completely eclipsed by corresponding cutting face 34-44*b;* stabilizing members 35-70*a, b* are completely eclipsed by corresponding cutting face 35-44*a;* and stabilizing members 36-70*a, b* are completely eclipsed by corresponding cutting face 36-44*b.*

Figure 7:
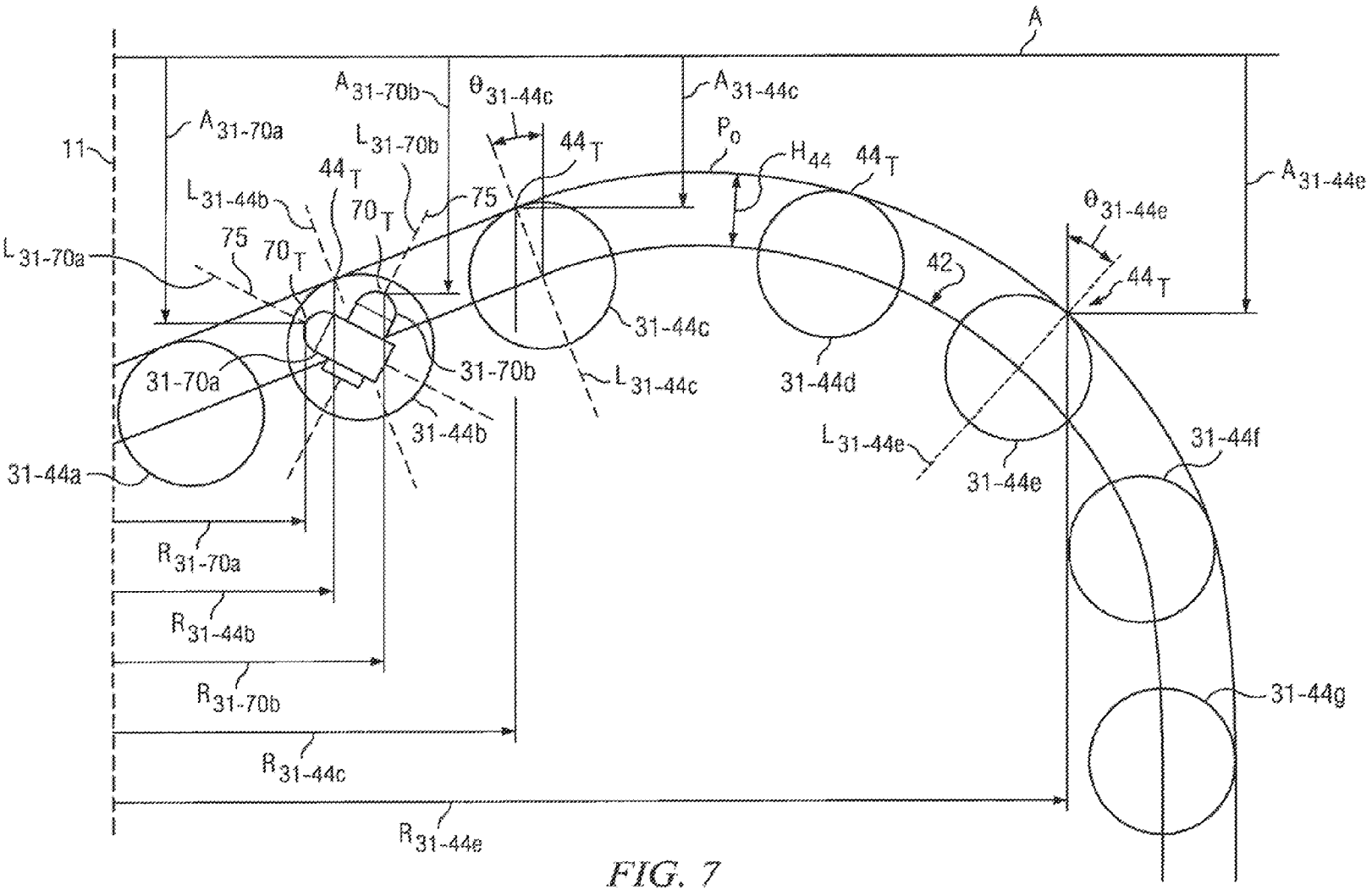
FIG. 7 is an enlarged rotated profile view of one of the primary blades and associated cutting faces and stabilizing members of FIG. 1.
Figure 8:
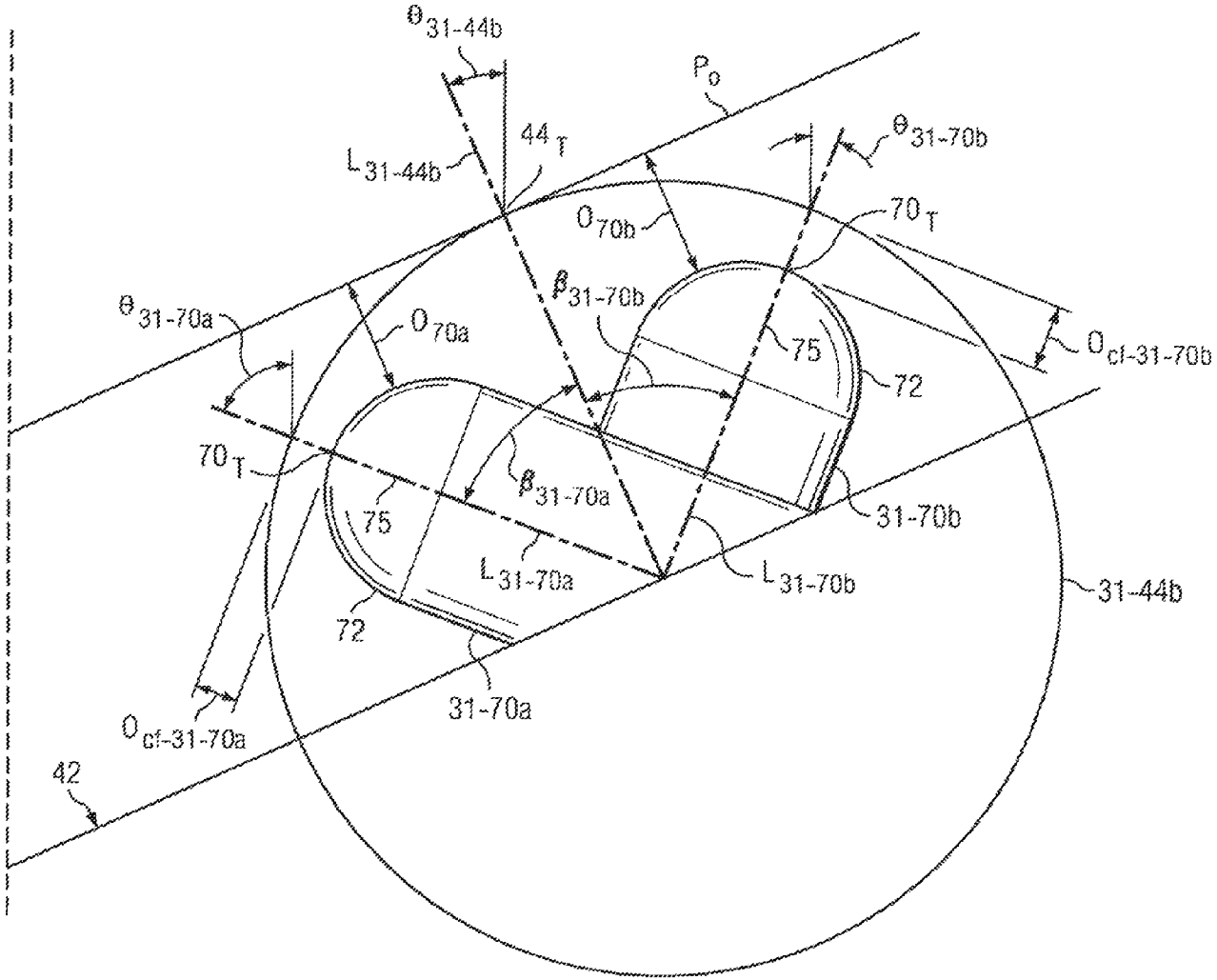
FIG. 8 is an enlarged rotated profile view of one of the cutting faces and associated stabilizing members of FIG. 7.

Referring now to FIGS. 7 and 8, for purposes of clarity and explanation, the concepts of axial position, radial position, profile angle line, profile angle, and stabilizing member angular orientation will be described with reference to exemplary blade 31, associated cutting faces 31-44*a-g,* and associated stabilizing members 31-70*a, b*. In FIG. 7, exemplary blade 31, associated cutting faces 31-44*a-g*, and associated stabilizing members 31-70*a, b* are schematically shown rotated into a single rotated profile view, and in FIG. 8, an enlarged view of cutting face 31-44*b* and stabilizing members 31-70*a, b* of FIG. 7 are shown. Although the general concepts of axial position, radial position, profile angle line, profile angle, and stabilizing member angular orientation are discussed below with reference to exemplary blade 31, associated cutting faces 31-44*a-g,* and associated stabilizing members 31-70*a, b*, these concepts apply equally to each cutter element (e.g., each cutter element 40), each cutting face (e.g., each cutting face 44), and each stabilizing member (e.g., each stabilizing member 70) of the embodiments described herein.

For purposes of this disclosure, the "axial position" of a cutting face is defined by the axial distance measured perpendicularly from a reference plane "A" that is perpendicular to the bit axis to the cutting tip of the cutting face. As previously described, each cutting face 44 has an outermost cutting tip $\mathbf{44}_T$ disposed at extension height $H_{44}$ along outermost composite cutting profile $P_o$. Thus, the axial position of each cutting face 44 is defined by the axial distance measured parallel to bit axis 11 (perpendicularly from reference plane A) to its cutting tip $\mathbf{44}_T$. For example, as shown in FIG. 7, the axial position of exemplary cutting face 31-44*c* is defined by an axial distance $A_{31\text{-}44c}$ measured perpendicularly from reference plane A (measured parallel to bit axis 11) to cutting tip $\mathbf{44}_T$ of cutting face 31-44*c*. As another example, the axial position of cutting face 31-44*e* is defined by an axial distance $A_{31\text{-}44e}$ measured perpendicularly from reference plane A (measured parallel to bit axis 11) to cutting tip $\mathbf{44}_T$ of cutting face 31-44*e*.

For purposes of this disclosure, the "radial position" of a cutting face is defined by the radial distance measured perpendicularly from the bit axis to the cutting tip of the cutting face. As previously described, each cutting face 44 has an outermost cutting tip $\mathbf{44}_T$ disposed at extension height $H_{44}$ along outermost composite cutting profile $P_o$. Thus, the radial position of each cutting face 44 is defined by the radial distance measured perpendicularly from bit axis 11 to its cutting tip $\mathbf{44}_T$. For example, as shown in FIG. 7, the radial position of cutting face 31-44*c* is defined by a radial distance $R_{31\text{-}44c}$ measured perpendicularly from bit axis 11 to cutting tip $\mathbf{44}_T$ of cutting face 31-44*c*. As another example, the radial position of cutting face 31-44*e* is defined by a radial distance $R_{31\text{-}44e}$ measured perpendicularly from bit axis 11 to cutting tip $\mathbf{44}_T$ of cutting face 31-44*e*.

For purposes of this disclosure, the "axial position" of a stabilizing member with a convex formation facing end (e.g., stabilizing member 70) is defined by the axial distance measured perpendicularly from reference plane "A" that is perpendicular to the bit axis to the bearing tip of the stabilizing member. As previously described, each stabilizing member 70 has a bearing tip $\mathbf{70}_T$ that is furthest from body 71 as measured parallel to longitudinal axis 75. Thus, the axial position of each stabilizing member 70 with convex end 72 is defined by the axial distance measured parallel to bit axis 11 (perpendicularly from reference plane A) to its bearing tip $\mathbf{70}_T$. For example, as shown in FIG. 7, the axial position of stabilizing member 31-70*a* is defined by an axial distance $A_{31\text{-}70a}$ measured perpendicularly from reference plane A (measured parallel to bit axis 11) to bearing tip $\mathbf{70}_T$ of stabilizing member 31-70*a*. As another example, the axial position of stabilizing member 31-70*b* is defined by an axial distance $A_{31\text{-}70b}$ measured perpendicularly from reference plane A (measured parallel to bit axis 11) to bearing tip $\mathbf{70}_T$ of stabilizing member 31-70*b*.

For purposes of this disclosure, the "radial position" of a stabilizing member with a convex formation facing end (e.g., stabilizing member 70) is defined by the radial distance measured perpendicularly from the bit axis to the bearing tip of the stabilizing member. As previously described, each stabilizing member 70 has a bearing tip $\mathbf{70}_T$ disposed on bearing end 72 at central axis 75. Thus, the radial position of each stabilizing member 70 with convex end 72 is defined by the radial distance measured perpendicularly from bit axis 11 to its bearing tip $\mathbf{70}_T$. For example, as shown in FIG. 7, the radial position of stabilizing member 31-70*a* is defined by a radial distance $R_{31\text{-}70a}$ measured perpendicularly from bit axis 11 to bearing tip $\mathbf{70}_T$ of stabilizing member 31-70*a*. As another example, the radial position of stabilizing member 31-70*b* is defined by a radial distance $R_{31\text{-}70b}$ measured perpendicularly from bit axis 11 to bearing tip $\mathbf{70}_T$ of stabilizing member 31-70*b*. Although stabilizing members 31-70*a, b* each trail associated cutter element 31-40*b* on the same blade 31, and are each completely eclipsed by cutting face 31-44*b* in rotated profile view, stabilizing member 31-70*a*, stabilizing member 31-70*b*, and associated cutting face 31-44*b* are each disposed at a different radial position $R_{31\text{-}70a}$, $R_{31\text{-}70b}$, $R_{31\text{-}44b}$, respectively, where radial position $R_{31\text{-}70a}$ is less than radial position $R_{33\text{-}44b}$, and radial position $R_{31\text{-}44b}$ is less than $R_{31\text{-}70b}$.

As best shown in FIG. 6, in this embodiment, each cutter element 40 and its associated cutting face 44 is disposed at a different and unique radial and/or axial position in rotated profile view. In cone and shoulder regions 24, 25, each cutter element 40 and its associated cutting face 44 is disposed at a different and unique radial position relative to bit axis 11 in rotated profile view. However, in gage region 26, multiple cutter elements 40 and their associated cutting faces 44 may be disposed at similar radial positions relative to bit axis 11. Further, in cone and shoulder regions 24, 25, one or more pairs of cutter elements 40 and their associated cutting faces 44 may be disposed at the same axial position relative to reference plane A in rotated profile view. However, in gage region 26, each cutter element 40 and its associated cutting face 44 is disposed at a different and unique axial position. Thus, no two cutter elements 40 or cutting faces 44 are disposed at the same radial position relative to bit axis 11 and axial position relative to reference plane A.

Although cutting faces 44 are each disposed at a different and unique radial position and/or axial position, due to their relative sizes and positions, cutting faces 44 at least partially overlap with one or more other cutting faces 44 in rotated profile view. In other words, each cutting face 44 is eclipsed by at least one other cutting face 44 in rotated profile view. In this manner, cutting faces 44 are positioned and arranged to enhance bottomhole coverage. In addition, in this embodiment, each stabilizing member 70 is disposed at a different and unique radial and/or axial position. As used herein, the phrase "unique" is used to described the radial or axial position of a cutter element or stabilizing member that is different from the radial or axial position, respectively, of every other cutter element and stabilizing member on the bit.

Referring again to FIG. 7, the position and orientation of each cutting face and each stabilizing member may also be described in terms of a "profile angle line" that bisects the cutting face/stabilizing member in rotated profile view, and a "profile angle." The profile angle line of a cutting face 44 bisects the cutting face 44 and is perpendicular to the outermost cutting profile $P_o$ in rotated profile view. Thus, as used herein, the "profile angle line" of a cutting face refers to a line that bisects the cutting face and is perpendicular to outermost cutting profile in rotated profile view. For example, as shown in FIG. 7, a profile angle line $L_{31\text{-}44e}$ is perpendicular to outermost composite cutting profile $P_o$ and bisects cutting face 31-44*e* in rotated profile view. As another example, profile angle line $L_{31\text{-}44c}$ is perpendicular to outermost cutting profile $P_o$ and bisects primary cutting face 31-44*c* in rotated profile view.

As used herein, the "profile angle line" of a stabilizing member refers to a line parallel to the central axis of the stabilizing member and that bisects the stabilizing member in rotated profile view. In this embodiment, central axis 75 of each stabilizing member 70 bisects the stabilizing member 70 in rotated profile view, and thus, the profile angle line of stabilizing member 70 extends along and is coincident with the central axis 75 in rotated profile view. For example, as shown in FIG. 8, a profile angle line $L_{31\text{-}70a}$ extends along central axis 75 of stabilizing member 31-70*a* in rotated profile view, and a profile angle line $L_{31\text{-}70b}$ extends along central axis 75 of stabilizing member 31-70*b* in rotated profile view.

Referring still to FIGS. 7 and 8, each profile angle line is oriented at a profile angle θ measured between the bit axis (or a line parallel to the bit axis) and the profile angle line in rotated profile view. Thus, as used herein, the phrase "profile angle" refers to the angle between a profile angle line and a line parallel to the bit axis in rotated profile view. For example, profile angle line $L_{31\text{-}44c}$ of primary cutting face 31-44*c* is oriented at a profile angle $\theta_{31\text{-}44c}$ and profile angle line $L_{31\text{-}44e}$ of primary cutting face 31-44*e* is oriented at a profile angle $\theta_{31\text{-}44e}$. As best shown in FIG. 8, profile angle line $L_{31\text{-}70a}$ of stabilizing member 31-70*a* is oriented at a profile angle $\theta_{31\text{-}70a}$, profile angle line $L_{31\text{-}70b}$ of stabilizing member 31-70*b* is oriented at a profile angle $\theta_{31\text{-}70b}$, and profile angle line $L_{31\text{-}44b}$ of cutting face 31-44*b* is oriented at a profile angle $\theta_{31\text{-}44b}$. Although stabilizing members 31-70*a, b* each trail associated cutter element 31-40*b* on the same blade 31, and are each completely eclipsed by cutting face 31-44*b* in rotated profile view, stabilizing member 31-70*a*, stabilizing member 31-70*b*, and associated cutting face 31-44*b* each have a different profile angle $\theta_{31\text{-}70a}$, $\theta_{31\text{-}70b}$, $\theta_{31\text{-}44b}$, respectively. As best shown in FIG. 6, in this embodiment of bit 10, each cutting face 44 is disposed at a unique profile angle in cone and shoulder regions 24, 25, and each stabilizing member 70 is disposed at a unique profile angle in cone and shoulder regions 24, 25. However, in other embodiments, one or more stabilizing member and/or one or more cutting face may have the same profile angle in the cone and/or shoulder region.

As best shown in FIGS. 1 and 5, as previously described, each stabilizing member 70 is disposed behind a corresponding cutter element 40 and associated cutting face 44 on the same blade 31-36. Thus, as used herein, the phrases "corresponding cutter element" and "corresponding cutting face" refer to the cutter element and cutting face, respectively, that leads a particular stabilizing member on the same blade and whose cutting profile completely eclipses the particular stabilizing member in rotated profile view. For example, stabilizing members 31-70*a, b* are disposed on the same blade 31 as cutter element 31-40*b* and associated cutting face 31-44*b* (FIG. 5) and are each completely eclipsed by cutting face 31-44*b* in rotated profile view (FIG. 7). Thus, each stabilizing member 31-70*a, b* has a corresponding cutter element 31-40*b* and corresponding cutting face 31-44*b*.

Referring now to FIGS. 6 and 8, in rotated profile view, each stabilizing member 70 is oriented at a non-zero tilt angle β relative to the profile angle line of its corresponding cutting face 44. The tilt angle β of each stabilizing member 70 is the angle measured between central axis 75 or profile angle line of the stabilizing member 70 and the profile angle line of its corresponding cutting face 44 in rotated profile view. Thus, as used herein, the phrase "tilt angle" refers to the angle measured between the central axis (e.g., central axis 75) or profile angle line of the stabilizing member (e.g., stabilizing member 70) and the profile angle line of its corresponding cutting face (e.g., corresponding cutting face 44) in rotated profile view. For example, as best shown in FIG. 8, stabilizing member 31-70*a* is oriented at an angle $\beta_{31\text{-}70a}$ measured between profile angle line $L_{31\text{-}70a}$ of stabilizing member 31-70*a* and profile angle line $L_{31\text{-}44b}$ of corresponding cutting face 31-44*b*, and stabilizing member 31-70*b* is oriented at an angle $\beta_{31\text{-}70b}$ measured between profile angle line $L_{31\text{-}70b}$ of stabilizing member 31-70*b* and profile angle line $L_{31\text{-}44b}$ of corresponding cutting face 31-44*b*. Tilt angle β of each stabilizing member 70 (in rotated profile view) is preferably an acute angle (i.e., less than 90°), and more preferably between 5° and 45°, and even more preferably between 5° and 22.5°. In this embodiment, each stabilizing member 70 is oriented at an angle β of about 22.5°.

Referring to now to FIGS. 6-8, each stabilizing member 70 is disposed within the cutting profile of its corresponding cutting face 44 in rotated profile view. In addition, bearing end 72 of each stabilizing member 70 is offset or spaced from the cutting profile of its corresponding cutting face 44 in rotated profile view—bearing end 72 of each stabilizing member 31-70*a, b*, 32-70*a, b* 35-70*a, b*, 34-70*a, b*, 36-70*a, b*, 33-70*a, b* is spaced from the cutting profile of its corresponding cutter element 31-44*b*, 32-44*c*, 35-44*a*, 34-44*b*, 36-44*b*, 33-44*e*, respectively, in rotated profile view. The amount or degree of offset of each stabilizing member 70 may be characterized by a "cutting face offset distance." As used herein, the phrase "cutting face offset distance" refers to the minimal or shortest distance between the bearing end (e.g., bearing end 72) of a particular stabilizing member (e.g., stabilizing member 70) and the cutting profile of its corresponding cutting face (i.e., cutting profile of the cutting face within which it is disposed) in rotated profile view.

As best shown in FIG. 6, each leading stabilizing member 70*a* has a cutting face offset distance $O_{cf\text{-}70a}$ equal to the shortest distance between its bearing end 72 and the cutting profile of its corresponding cutting face 44, and each trailing stabilizing member 70*b* has a cutting face offset distance $O_{cf\text{-}70b}$ equal to the shortest distance between its bearing end 72 and the cutting profile of its corresponding cutting face 44. For example, as shown in FIG. 8, bearing end 72 of leading stabilizing member 31-70*a* has a cutting face offset distance $O_{cf\text{-}31\text{-}70a}$ equal to the shortest distance between bearing end 72 of stabilizing member 31-70*a* and the cutting profile of its corresponding cutting face 31-44*b* in rotated profile view. Further, bearing end 72 of trailing stabilizing member 31-70*b* has a cutting face offset distance $O_{cf\text{-}31\text{-}70b}$ equal to the shortest distance between bearing end 72 of stabilizing member 31-70*b* and the cutting profile of its corresponding cutting face 31-44*b* in rotated profile view. In this embodiment, cutting face offset distance $O_{cf\text{-}31\text{-}70a}$ of leading stabilizing member 31-70*a* is less than cutting face offset distance $O_{cf\text{-}31\text{-}70b}$ of trailing stabilizing member 70*b*. In general, for each given pair of leading and trailing stabilizing members 70*a, b* on a given blade 31-36, the leading stabilizing member 70*a* preferably has a cutting face offset distance that is less than the cutting face offset distance of the trailing stabilizing member 70*b* relative to the cutting profile of the same corresponding cutting face 44 in rotated profile view. Accordingly, for each given pair of leading and trailing stabilizing members 70*a, b* on a given blade 31-36, bearing end 72 of the leading stabilizing member 70*a* is preferably closer to the cutting profile of its corresponding cutting face 44 than the trailing stabilizing member 70*b* in rotated profile view. In addition, the cutting face offset distance $O_{cf\text{-}70a}$ of each leading stabilizing member 70*a* is preferably between 0.020 in. (~0.508 mm) and 0.100 in. (~2.54 mm), and more preferably between about 0.040 in. (~1.016 mm) and 0.060 in. (~1.524 mm), and the cutting face offset distance $O_{cf\text{-}70b}$ of each trailing stabilizing member 70*b* is preferably between 0.020 in. (~0.508 mm) and 0.100 in. (~2.54 mm), and more preferably between about 0.040 in. (~1.016 mm) and 0.060 in. (~1.524 mm).

It should be appreciated that the "composite cutting profile offset distance" and the "cutting face offset distance" of a given stabilizing member 70 are different. Specifically, the "composite cutting profile offset distance" is the shortest distance between bearing end 72 of a given stabilizing member 70 and outermost cutting profile $P_o$, whereas "cutting face offset distance" is the shortest distance between bearing end 72 of a given stabilizing member 70 and the cutting profile of its corresponding cutting face 44. As angle β between central axis 75 of a stabilizing member 70 approaches 90°, the "composite cutting profile offset distance" and the "cutting face offset distance" generally converge.

Figure 9:
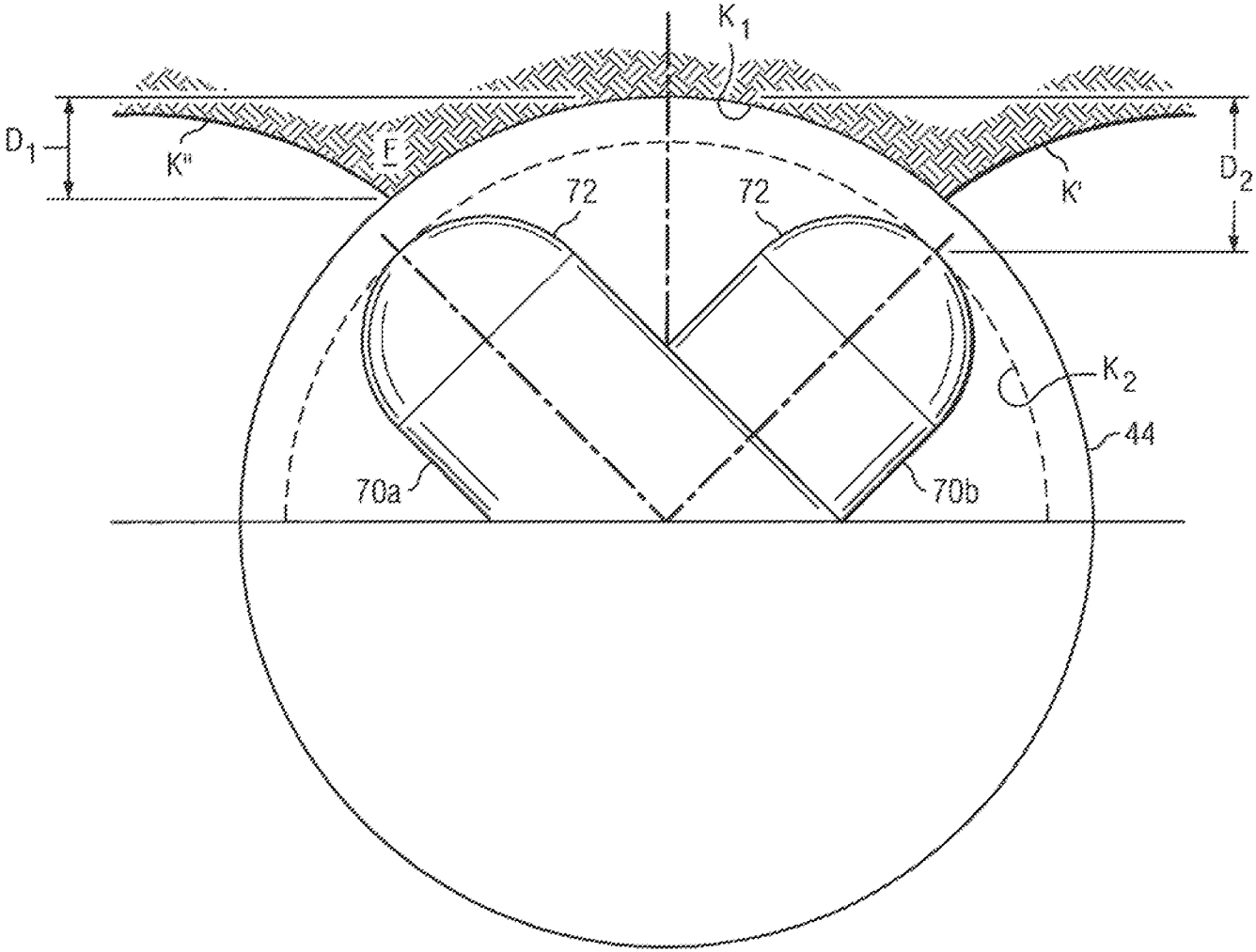
FIG. 9 is an enlarged view rotated profile view of the cutting face of FIG. 8 engaging and penetrating the formation.

By adjusting the position, orientation, and extension height of the stabilizing members (e.g., stabilizing members 70*a, b*), the depth-of-cut of their associated cutting face (e.g., cutting face 44) may be limited and controlled. More specifically, during drilling operations, each cutting face (e.g., each cutting face 44) engages, penetrates, and shears the formation as the bit (e.g., bit 10) is rotated in the cutting direction (e.g., cutting direction 18) and is advanced through the formation toward a target zone. As each cutting face advances through the formation, it cuts a kerf in the formation generally defined by the cutting profile of the cutting face. The depth-of-cut of the cutting face refers to the depth to which the cutting face penetrates the formation. In embodiments described herein, when the depth-of-cut of the cutting face is sufficiently large, the bearing ends of the stabilizing members associated with and trailing the cutting face will engage the formation, and more specifically, engage the kerf cut in the formation by the cutting face. The stabilizing members are not intended to penetrate and shear the formation, but rather, contact and slide across the formation, thereby limiting a further increase in the depth-of-cut of their associated cutting face. For example, as best shown in FIG. 9, exemplary cutting face 44 cuts a kerf $K_1$ in the formation F at a first depth-of-cut $D_1$. Kerfs K' and K" on opposite sides of kerf $K_1$ represent the kerfs cut by the cutting faces of radially adjacent cutting face 44 in rotated profile view. At a first depth-of-cut $D_1$, stabilizing members 70*a, b* do not contact the formation and kerf $K_1$. However, at a second depth-of-cut $D_2$ that is greater than first depth-of-cut $D_1$, bearing ends 72 of stabilizing members 70*a, b* contact the formation and kerf $K_2$. As stabilizing members 70*a, b* are non-aggressive and not intended to penetrate or shear the formation, bearing ends 72 slide across the formation, thereby limiting the penetration of cutting face 44 to second depth-of-cut to $D_2$.

In the embodiment of bit 10 shown in FIGS. 1-6, for each pair of stabilizing members (e.g., stabilizing members 70*a, b*) on a given blade, one stabilizing member is positioned to contact the one lateral ridge of the kerf formed by its corresponding cutting face, and the other stabilizing member is positioned to contact the opposite lateral ridge of the kerf formed by the corresponding cutting face. For example, as shown in FIG. 8, bearing end 72 of leading stabilizing member 31-70*a* is positioned proximal the upper left portion of the cutting profile of cutting face 31-44*b*, and bearing end of trailing stabilizing member 31-70*b* is positioned proximal the upper right portion of the cutting profile of cutting face 31-44*b;* bearing end 72 of stabilizing member 31-70*a* is positioned proximal the cutting profile of cutting face 31-44*b* on the left side of profile angle line $L_{31\text{-}44b}$, and bearing end 72 of stabilizing member 31-70*b* is positioned proximal the cutting profile of cutting face 31-44*b* on the right side of profile angle line $L_{31\text{-}44b}$.

As best shown in FIG. 5, in this embodiment of bit 10, each leading stabilizing member 70*a* is positioned and oriented to contact the radially inner ridge of the kerf formed by its associated cutting face 44, and the trailing stabilizing member 70*b* is positioned and oriented to contact the radially outer ridge of the kerf formed by its associated cutting face 44. However, in general, one or more leading stabilizing members (e.g., stabilizing members 70*a*) and/or one or more trailing stabilizing members (e.g., stabilizing members 70*b*) may be positioned and oriented to contact the radially inner ridge or radially outer ridge of the kerf cut by its associated cutting face.

As is known in the art, during drilling, each individual cutting face sweeps a generally helical path as the bit is rotated and advanced through the formation. Thus, the stabilizing members trailing a particular cutting face effectively move axially (relative to the bit axis) towards formation and the kerf cut by that cutting face during drilling. Leading and trailing stabilizing members described herein (e.g., stabilizing members 70*a, b*) are preferably positioned and oriented such that the leading and trailing stabilizing members first contact the formation at the same depth-of-cut taking into account the helical advancement of individual structures on the bit face.

As previously described, each stabilizing member 70*a, b* has a cutting profile offset distance $O_{70a}$, $O_{70b}$, respectively, and a cutting face offset distance where offset distance $O_{cf\text{-}70a}$, $O_{cf\text{-}70b}$, respectively. For each pair of stabilizing members 70*a, b* on a given blade 31-36, cutting profile offset distance $O_{70a}$ and cutting face offset distance $O_{cf\text{-}70a}$ of each leading stabilizing member 70*a* are preferably less than cutting profile offset distance $O_{70b}$ and cutting face offset distance $O_{cf\text{-}70b}$ of each trailing stabilizing member 70*b* in rotated profile view. In other words, for each pair of stabilizing members 70*a, b* on a given blade 31-36, bearing end 72 of the leading stabilizing member 70*a* is preferably closer to the outermost cutting profile $P_o$ and closer to the cutting profile of its associated cutting face 44 than bearing end 72 of the trailing stabilizing member 70*b* in rotated profile view. Such differences in cutting profile offset distance $O_{70a}$, $O_{70b}$ and cutting face offset distances $O_{cf\text{-}70a}$, $O_{cf\text{-}70b}$ are preferably pre-determined to account for the helical advance of cutting faces 44, such that bearing ends 72 of leading stabilizing member 70*a* and trailing stabilizing member 70*b* of each pair of stabilizing members 70*a, b* on a given blade 31-36 contact the formation and kerf cut by their corresponding cutting face at substantially the same depth-of-cut.

By limiting the depth-of-cut, the stabilizing members described herein offer the potential to reduce problems associated with excessive depths-of-cut such as excessive wear and damage to cutting faces during transitions from soft to hard formation and bit balling. Further, stabilizing members also offer the potential to enhance bit stability and reduce bit vibrations during drilling. Specifically, as the bearing ends of the stabilizing members engage the ridges of the kerf formed by their corresponding cutting faces, they restrict lateral movement of the bit within the borehole.

Figure 11:
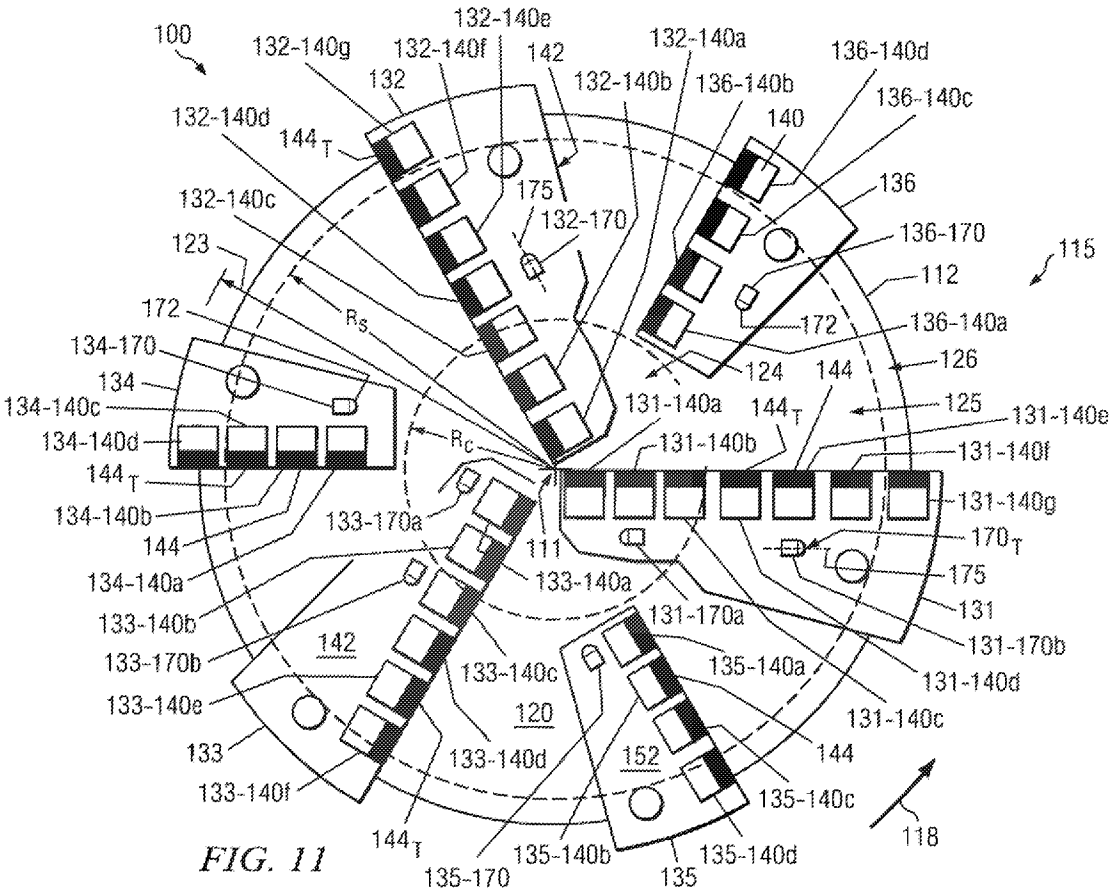
FIG. 11 is a schematic top view of an embodiment of a bit made in accordance with the principles described here.

Referring now to FIG. 11, another embodiment of a fixed cutter drill bit 100 adapted for drilling through formations of rock to form a borehole is shown. Bit 100 is similar to bit 10 previously described. Namely, bit 100 includes a bit body 112 and a bit face 120 that supports a cutting structure 115. Bit 100 further includes a central axis 111 about which bit 100 rotates in the cutting direction represented by arrow 118.

Moving radially outward from bit axis 111, bit face 120 includes a radially inner cone region 124, a radially intermediate shoulder region 125, and a radially outer gage region 126 similar to region 24, 25, 26, respectively, previously described. Cone region 124 extends radially from bit axis 111 to a cone radius $R_c$, shoulder region 125 extends radially from cone radius $R_c$ to shoulder radius $R_s$, and gage region 126 extends radially from shoulder radius $R_s$ to bit outer radius 123. Similar to regions 24, 25, 26, previously described, in this embodiment, cone region 124 is concave, shoulder region 125 is generally convex, and gage region 126 extends substantially parallel to bit axis 111.

Cutting structure 115 includes three primary blades 131, 132, 133 circumferentially spaced-apart about bit axis 111, and three secondary blades 135, 135, 136 circumferentially spaced apart about bit axis 111. In this embodiment, primary blades 131, 132, 133 and secondary blades 134, 135, 136 are circumferentially arranged in an alternating fashion. In this embodiment, the plurality of blades (e.g., primary blades 131, 132, 133 and secondary blades 135, 135, 136) are uniformly angularly spaced on bit face 120 about bit axis 111. Each primary blade 131, 132, 133 includes a cutter-supporting surface 142 for mounting a plurality of cutter elements, and each secondary blade 134, 135, 136 includes a cutter-supporting surface 152 for mounting a plurality of cutter elements.

Referring still to FIG. 11, a plurality of primary cutter elements 140, each having a forward-facing cutting face 144, are mounted to cutter-supporting surface 142, 152 of each primary blade 131, 132, 133 and each secondary blade 134, 135, 136, respectively. Cutter elements 140 are generally arranged adjacent one another in a radially extending row proximal the leading edge of each blade 131-136, relative to the cutting direction of bit 100 represented by arrow 118. Each cutting face 144 has an outermost cutting tip $\mathbf{144}_T$ positioned furthest from cutter-supporting surface 142, 152 to which it is mounted (as measured perpendicularly from its respective cutter-supporting surface 142, 152).

Referring still to FIG. 11, bit 100 also comprises a plurality of stabilizing members 170 supported by cutter-supporting surfaces 142, 152. In this embodiment, at least one stabilizing members 170 extends from cutter-supporting surfaces 142, 152 of each blade 131-136. Each stabilizing member 170 on a given blade 131-136 trails the row of cutter elements 140 provided on the same blade 131-136. Stabilizing members 170 are similar to stabilizing members 70 previously described. Namely, each stabilizing member 170 comprises a cylindrical body having a central or longitudinal axis 175 and a semi-spherical or dome-shaped end 172 with a bearing tip $\mathbf{170}_T$ coincident with central axis 175. Further, each stabilizing member 170 is secured in a mating socket in its respective cutter-supporting surface 142, 152 with its dome-shaped end 172 extending from cutter-supporting surface 142, 152.

Similar to stabilizing members 70 previously described, stabilizing members 170 offer the potential to enhance bit stability, as well as limit the maximum depth-of-cut of cutting faces 144 as they engage the formation. In particular, dome-shaped ends 172 of each pair of stabilizing members 170 are intended to bear against the uncut formation and slide across the ridges of uncut formation on opposite sides of the kerf created by cutting faces 144 on circumferentially adjacent blades 131-136. As will be described in more detail below, stabilizing members 170 are arranged such that two stabilizing members 170 on circumferentially adjacent blades 131-136 are positioned to engage opposite sides of the same ridge defined by the kerfs formed by their corresponding cutter elements 140.

For purposes of clarity and further explanation, moving radially outward from bit axis 111, cutter elements 140 mounted to primary blades 131, 132 are assigned reference numerals 131-140*a-g*, 132-140*a-g*, respectively there being seven primary cutter elements 140 mounted to each primary blade 131, 132; cutter elements 140 mounted to primary blade 133 are assigned reference numerals 133-140*a-f* there being six primary cutter elements 140 mounted to each primary blade 131, 132; and cutter elements 140 mounted to secondary blades 134, 135, 136 are assigned reference numerals 134-140*a-d*, 135-140*a-d*, 136-140*a-d*, respectively, there being four primary cutter elements 140 mounted to each secondary blade 134, 135, 136. In addition, stabilizing members 170 extending from primary blades 131, 133 are assigned reference numerals 131-170*a, b*, 133-170*a, b*, respectively, there being two stabilizing members on each primary blade 131, 133; and stabilizing members 170 extending from blades 132, 134, 135, 136 are assigned reference numerals 131-170, 134-170, 135-170, 136-170, respectively, there being one stabilizing member 170 on each blade 132, 134, 135, 136.

Referring still to FIG. 11, each stabilizing member 170 immediately trails a corresponding cutter element 140 disposed on the same blade 131-136. In particular, stabilizing member 131-170*a* trails corresponding cutter element 131-140*b*; stabilizing member 131-170*b* trails corresponding cutter element 131-140*e*; stabilizing member 132-170 trails corresponding cutter element 132-140*d*; stabilizing member 133-170*a* trails corresponding cutter element 133-140*a*; stabilizing member 133-170*b* trails corresponding cutter element 133-140*c*; stabilizing member 134-170 trails corresponding cutter element 134-140*a*; stabilizing member 135-170 trails corresponding cutter element 135-140*a*; and stabilizing member 136-170 trails corresponding cutter element 136-140*b*. As previously described, the stabilizing members (e.g., stabilizing members 170), designed to enhance bit stability and control depth-of-cut to reduce impact loads to cutter elements are preferably positioned in the cone and shoulder regions of the bit to limit the "bite," and thereby protect, the cutter elements mounted therein. In this embodiment, stabilizing members 131-170*a*; 133-170*a* are disposed in cone region 124; and remaining stabilizing members 131-170*b*, 132-170, 133-170*b*, 134-170, 135-170, and 136-170 are disposed in shoulder region 125.

Figure 12:
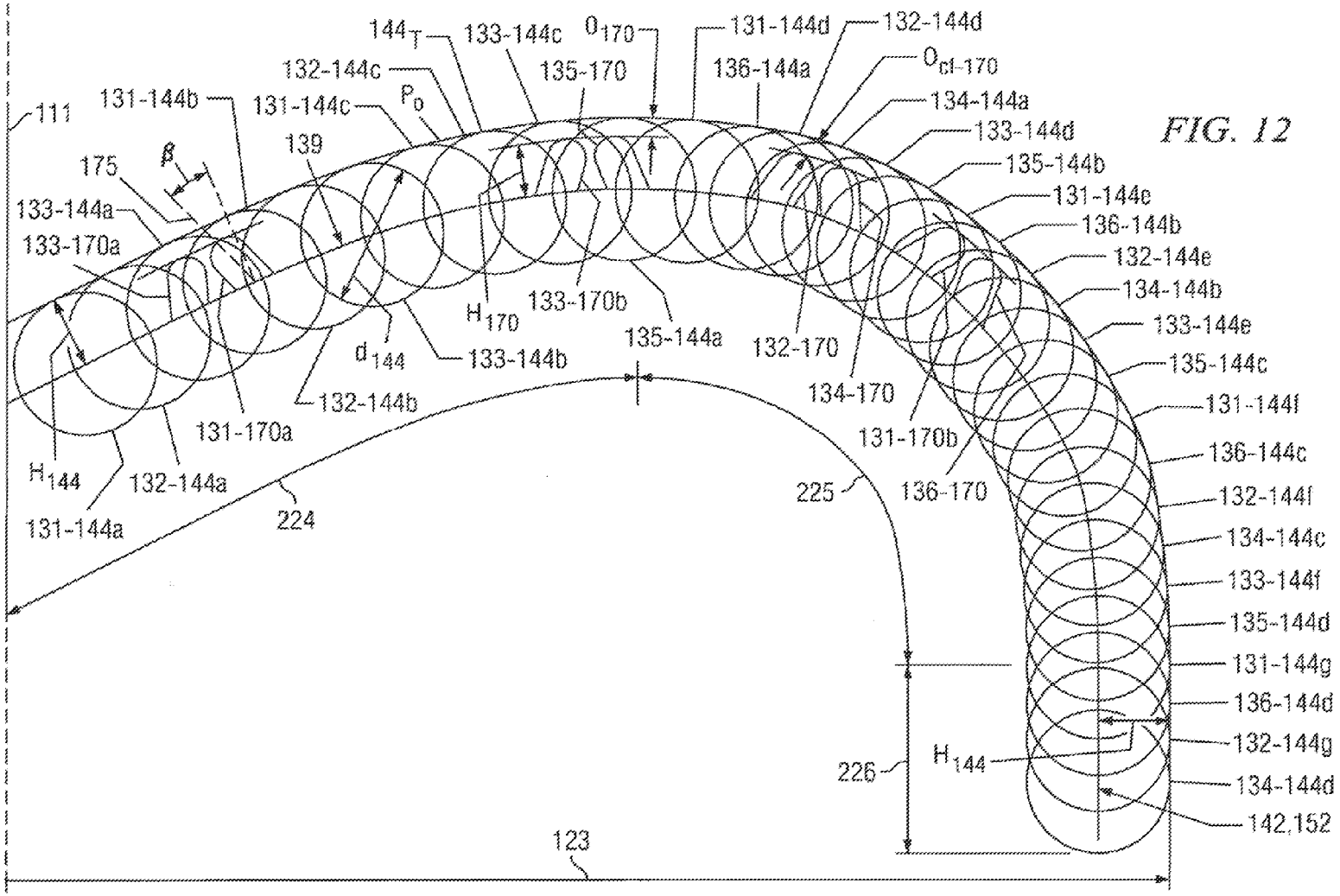
FIG. 12 is a schematic view showing the blades, the cutting faces, and the stabilizing members of FIG. 11 rotated into a single composite rotated profile.
Figure 13:
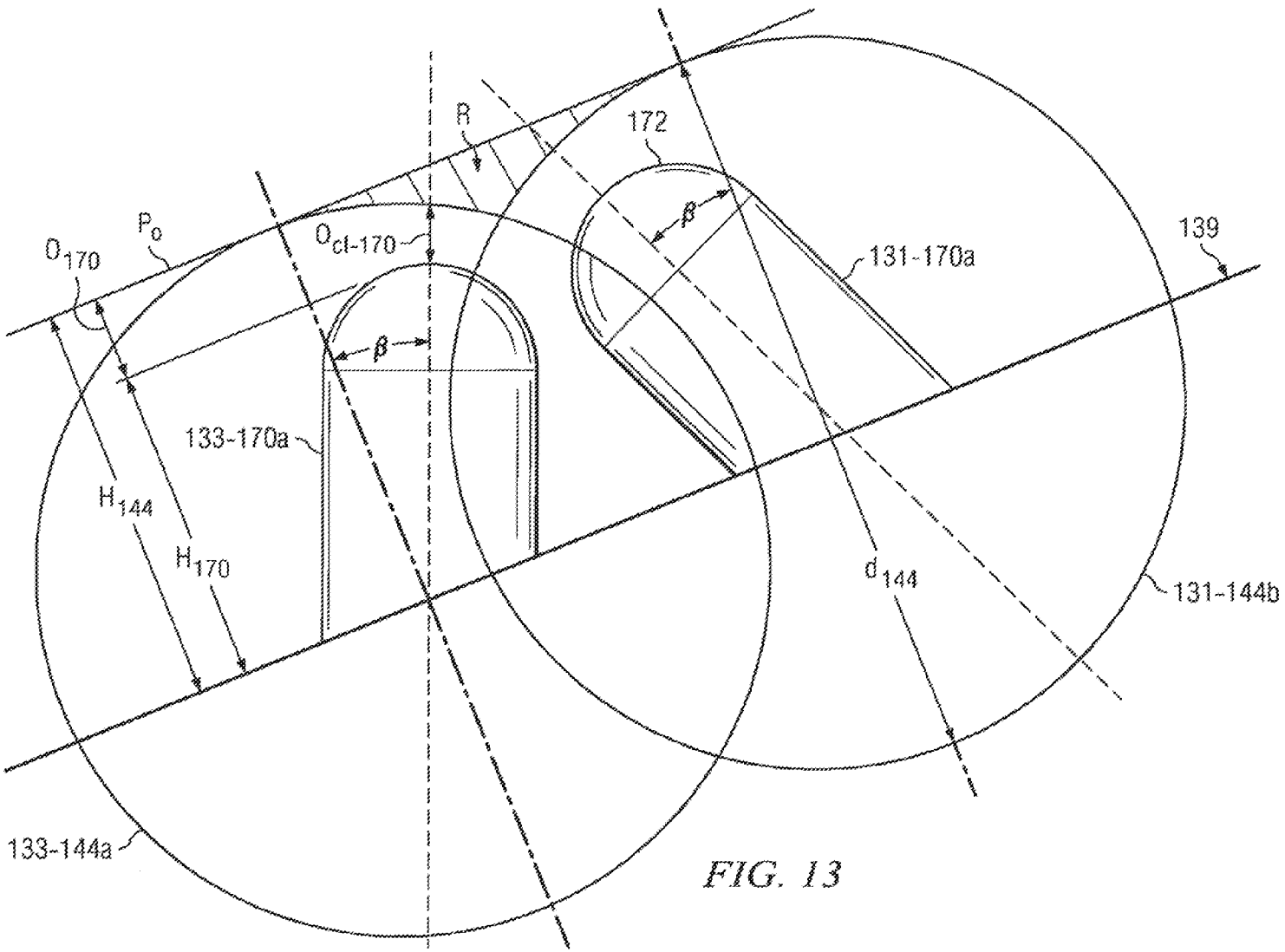
FIG. 13 is an enlarged view of two stabilizing members and associated cutting faces of FIG. 12.

In FIG. 12, the profiles of primary blades 131, 132, 133, secondary blades 134, 135, 136, cutting faces 144, and stabilizing members 170 are schematically shown rotated into a single composite rotated profile view. For purposes of clarity and further explanation, cutting faces 144 of primary cutter elements 131-140*a-g*, 132-140*a-g*, 133-140*a-f*, 134-140*a-d*, 135*a-d*, 136-140*a-d* are assigned reference numerals 131-144*a-g*, 132-144*a-g*, 133-144*a-f*, 134-144*a-d*, 135-144*a-d*, 136-144*a-d*, respectively. In FIG. 13, an enlarged rotated profile view of stabilizing members 131-170*a*, 133-170*a* and corresponding cutting faces 131-144*b*, 133-144*a*, respectively, is shown.

Referring now to FIGS. 12 and 13, in rotated profile view, cutter-supporting surface 142, 152 of each blade 131-136 extends along and defines a single composite blade profile 139. In addition, each cutting face 144 (i.e., each cutting face 131-144*a-g*, 132-144*a-g*, 133-144*a-f*, 134-144*a-d*, 135-144*a-d*, 136-144*a-d*) extends to substantially the same extension height $H_{144}$ measured perpendicularly from cutter-supporting surfaces 142, 152 (or blade profile 139). Cutting tips $\mathbf{144}_T$ of cutting faces 144 are each disposed at extension height $H_{144}$ and define an outermost cutting profile $P_o$ that extends radially from bit axis 111 to outer radius 123.

Referring still to FIGS. 12 and 13, each stabilizing member 131-170*a, b*, 132-170, 133-170*a, b*, 134-170, 135-170, 136-170 extends to substantially the same extension height $H_{170}$ that is less than extension height $H_{144}$. Thus, stabilizing members 131-170*a, b*, 132-170, 133-170*a, b*, 134-170, 135-170, 136-170 are offset from the outermost composite cutting profile $P_o$ by a composite cutting profile offset distance $O_{170}$ equal to the shortest distance between its bearing end 172 and outermost composite cutting profile $P_o$. Composite cutting profile offset distance $O_{170}$ is preferably between 0.020 in. (~0.508 mm) and 0.100 in. (~2.54 mm), and more preferably between 0.040 in. (~1.016 mm) and 0.060 in. (~1.524 mm).

In this embodiment, each cutter element 140 has substantially the same cylindrical geometry and size. Consequently, each cutting face 144 has substantially the same diameter $d_{144}$. Diameter $d_{144}$ of each cutting face 144 is preferably between about 13 mm (~0.512 in.) and 19 mm (~0.748 in.). Further, in this embodiment, each stabilizing member 170 has substantially the same cylindrical geometry and size. For most applications and bit sizes, stabilizing members 170 preferably have a diameter between about 0.433 in. (~11 mm) and about 0.748 in. (~19 mm), and more preferably between about 0.512 in. (~13 mm) and about 0.63 in. (~16 mm).

As a result of the relative sizes and radial positions cutting faces 144 and stabilizing members 170, each stabilizing member 170 is completely eclipsed by its corresponding cutting face 144 in rotated profile view. For example, stabilizing member 131-170*a*, is completely eclipsed by corresponding cutting face 131-144*b, e*, respectively; stabilizing member 132-170 is completely eclipsed by corresponding cutting face 132-144*d*; stabilizing member 133-70*a, b* is completely eclipsed by corresponding cutting face 133-144*a, c*, respectively; stabilizing member 134-170 is completely eclipsed by corresponding cutting face 134-144*a*; stabilizing member 135-170 is completely eclipsed by corresponding cutting face 135-144*a;* and stabilizing member 136-170 is completely eclipsed by corresponding cutting face 136-144*b*.

As best shown in FIG. 12, in this embodiment, each cutter element 140 and its associated cutting face 144 is disposed at a different and unique radial position (relative to bit axis 111) and/or axial position (relative to a reference plane that is perpendicular to bit axis 111) in rotated profile view. In cone and shoulder regions 124, 125, each cutter element 140 and its associated cutting face 144 is disposed at a different and unique radial position relative to bit axis 111 in rotated profile view. However, in gage region 126, multiple cutter elements 140 and their associated cutting faces 144 may be disposed at similar radial positions. In cone and shoulder regions 124, 125, one or more pair of cutter elements 140 and their associated cutting faces 144 may be disposed at the same axial position relative to a reference plane that is perpendicular to bit axis 111 in rotated profile view. However, in gage region 126, each cutter element 140 and its associated cutting face 144 is disposed at a different and unique axial position. Thus, no two cutter elements 140 or cutting faces 144 are disposed at the same radial position relative to bit axis 111 and the same axial position relative to a reference plane that is perpendicular to bit axis 111.

Although cutting faces 144 are disposed in different radial positions and/or axial positions, due to their relative sizes and positions, each cutting face 144 at least partially overlap with one or more other cutting faces 144 in rotated profile view. In other words, each cutting face 144 is eclipsed by at least one other cutting face 144 in rotated profile view. In this manner, cutting faces 144 are positioned and arranged to enhance bottomhole coverage. In addition, in this embodiment, each stabilizing member 170 is disposed at a different and unique radial position (relative to bit axis 111) and/or axial position (relative to a reference plane that is perpendicular to bit axis 111) in rotated profile view. Further, in this embodiment of bit 100, each cutting face 144 is disposed at a unique profile angle in cone and shoulder regions 124, 125, and each stabilizing member 170 is disposed at a unique profile angle in cone and shoulder regions 124, 125.

Referring again to FIGS. 12 and 13, in rotated profile view, each stabilizing member 170 is oriented at a non-zero tilt angle β relative to the profile angle line of its corresponding cutting face 144. Tilt angle β of each stabilizing member 170 (in rotated profile view) is preferably an acute angle (i.e., less than 90°), and more preferably between 5° and 45°, and even more preferably between 5° and 22.5°. In this embodiment, each stabilizing member 170 is oriented at an angle β of about 22.5°.

In this embodiment, each stabilizing member 170 is disposed within the cutting profile of its corresponding cutting face 144 in rotated profile view. As best shown in FIG. 13, bearing end 172 of each stabilizing member 170 is offset or spaced from the cutting profile of its corresponding cutting face 144 in rotated profile view by cutting face offset distance. In this embodiment, each stabilizing member 170 has a cutting face offset distance $O_{cf\text{-}170}$ equal to the shortest distance between its bearing end 172 and the cutting profile of its corresponding cutting face 144. In this embodiment, each stabilizing member 170 has the same cutting face offset distance $O_{cf\text{-}170}$ relative to its corresponding cutting face 144. Cutting face offset distance $O_{cf\text{-}170}$ of each stabilizing member 170 is preferably between 0.020 in. (~0.508 mm) and 0.100 in. (~2.54 mm), and more preferably between about 0.040 in. (~1.016 mm) and 0.060 in. (~1.524 mm).

By adjusting the position, orientation, and extension height of the stabilizing members (e.g., stabilizing members 170), the depth-of-cut of their associated cutting face (e.g., cutting face 144) may be limited and controlled. More specifically, during drilling operations, each cutting face (e.g., each cutting face 144) engages, penetrates, and shears the formation as the bit (e.g., bit 100) is rotated in the cutting direction (e.g., cutting direction 118) and is advanced through the formation toward a target zone. As each cutting face advances through the formation, it cuts a kerf in the formation generally defined by the cutting profile of the cutting face. The depth-of-cut of the cutting face refers to the depth to which the cutting face penetrates the formation. In embodiments described herein, when the depth-of-cut of the cutting face is sufficiently large, the bearing ends of the stabilizing members associated with and trailing the cutting face will engage the formation, and more specifically, engage the kerf cut in the formation by their corresponding cutting faces. The stabilizing members are not intended to penetrate and shear the formation, but rather, contact and slide across the formation, thereby limiting a further increase in the depth-of-cut of their associated cutting face.

In this embodiment of bit 100, stabilizing members 170 are generally arranged such that two stabilizing members 170 on different, but circumferentially adjacent blades 131-136 are positioned to engage opposite sides of the same ridge defined by the kerfs formed by their corresponding cutting faces 144. For example, as best shown in FIG. 13, stabilizing member 131-170*a* is disposed on blade 131 behind its corresponding cutting face 131-144*b*, and stabilizing member 133-170*a* is disposed on blade 133 behind its corresponding cutting face 133-144*a*. Within cone region 124, primary blades 131, 133 are circumferentially adjacent each other since there are no secondary blades (e.g., secondary blades 134, 135, 136) extending into the cone region circumferentially between the primary blades. In rotated profile view, cutting faces 133-144*a*, 131-144*b* are radially adjacent each other and their cutting profiles. Consequently, the kerfs cut by cutting faces 133-144*a*, 131-144*b* define a ridge R of uncut formation that extends between cutting faces 133-144*a*, 131-144*b*. Bearing end 172 of stabilizing member 133-170*a* is positioned proximal the upper right portion of the cutting profile of cutting face 133-144*a* (i.e., on radially outer side of the profile angle line of cutting face 133-144*a*), and bearing end 172 of stabilizing member 131-170*a* is positioned proximal the upper left portion of the cutting profile of cutting face 131-144*b* (i.e., on radially inner side of the profile angle line of cutting face 131-144*b*). Further, bearing ends 172 of stabilizing members 133-170*a*, 131-170*a* are positioned to engage opposite radial sides of ridge R. Namely, bearing end 172 of stabilizing member 133-170*a* is positioned to engage the radially inner half of ridge R at a depth-of-cut generally equal to offset $O_{170}$, and stabilizing member 131-170*a* is positioned to engage the radially outer half of ridge R at a depth-of-cut generally equal to offset $O_{170}$. Thus, stabilizing members 131-170*a*, 133-170*a* are arranged in cone region 124 on circumferentially adjacent blades 131, 133, respectively, to engage opposite sides of the same ridge R defined by the kerfs formed by their corresponding cutting faces 131-144*b*, 133-144*a*, respectively. Likewise, as best shown in FIG. 12, the pair of stabilizing members 133-170*b*, 135-170 are arranged in shoulder region 125 on circumferentially adjacent blades 133, 135, respectively, to engage opposite sides of the ridge defined by the kerfs formed by corresponding cutting faces 133-144*c*, 135-144*a*, respectively; the pair of stabilizing members 132-170, 134-170 are arranged in shoulder region 125 on circumferentially adjacent blades 132, 134, respectively, to engage opposite sides of the ridge defined by the kerfs formed by corresponding cutting faces 132-144*d*, 134-144*a*, respectively; and the pair of stabilizing members 131-170*b*, 136-170 are arranged in shoulder region 125 on circumferentially adjacent blades 131, 136, respectively to engage opposite sides of the ridge defined by the kerfs formed by corresponding cutting faces 131-144*e*, 136-144*b*, respectively.

By limiting the depth-of-cut, the stabilizing members described herein offer the potential to reduce problems associated with excessive depths-of-cut such as excessive wear and damage to cutting faces during transitions from soft to hard formation and bit balling. Further, stabilizing members also offer the potential to enhance bit stability and reduce bit vibrations during drilling. Specifically, as the bearing ends of the stabilizing members engage the ridges defined by the kerfs of their corresponding cutting faces, they restrict lateral movement of the bit within the borehole.

Figure 14:
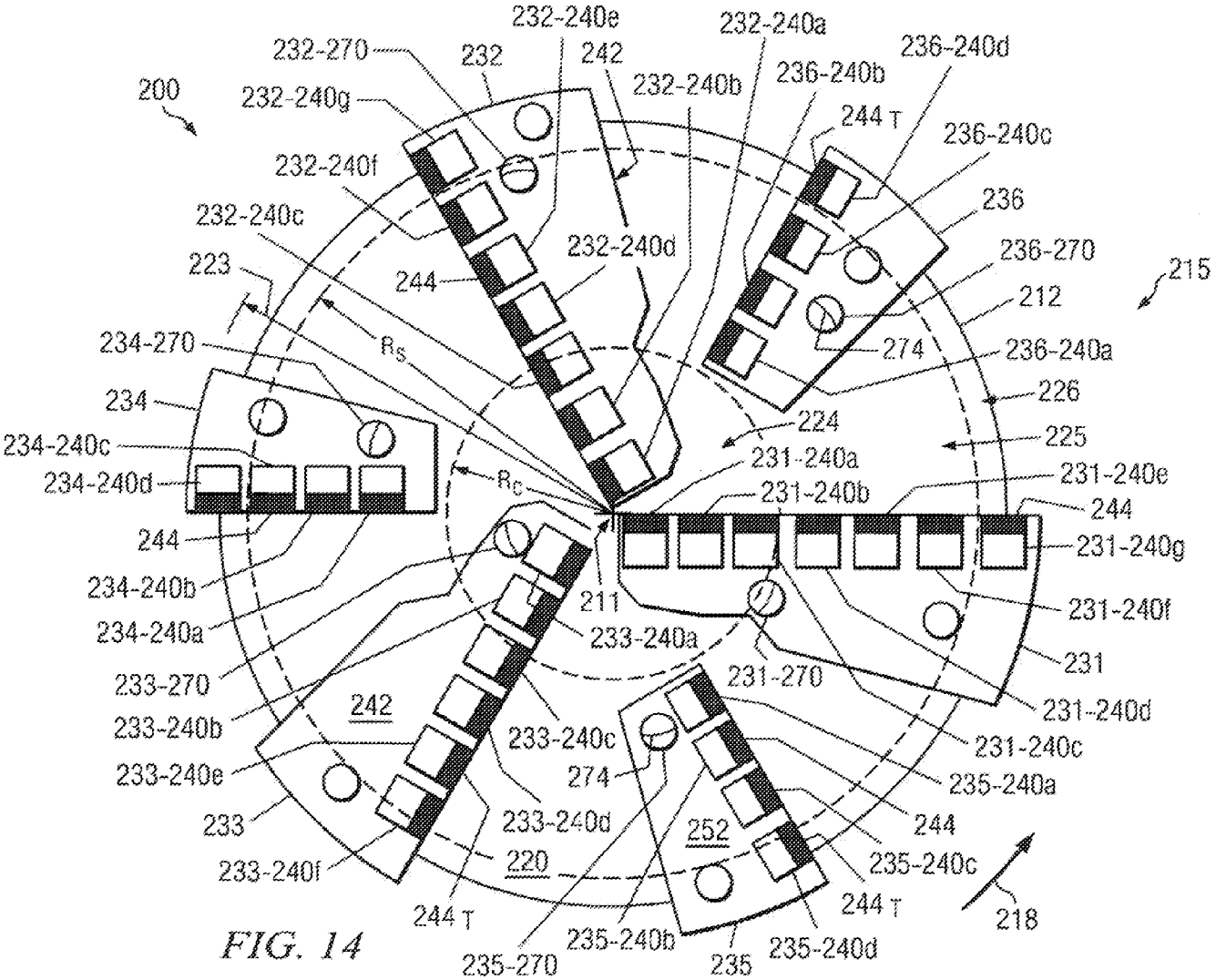
FIG. 14 is a schematic top view of an embodiment of a bit made in accordance with the principles described herein.

Referring now to FIG. 14, another embodiment of a fixed cutter drill bit 200 adapted for drilling through formations of rock to form a borehole is shown. Bit 200 is similar to bits 10, 100 previously described. Namely, bit 200 includes a bit body 212 and a bit face 220 that supports a cutting structure 215. Bit 200 further includes a central axis 211 about which bit 200 rotates in the cutting direction represented by arrow 218.

Moving radially outward from bit axis 211, bit face 220 includes a radially inner cone region 224, a radially intermediate shoulder region 225, and a radially outer gage region 226 similar to region 24, 25, 26, respectively, previously described. Cone region 224 extends radially from bit axis 211 to a cone radius $R_c$, shoulder region 225 extends radially from cone radius $R_c$ to shoulder radius $R_s$, and gage region 226 extends radially from shoulder radius $R_s$ to bit outer radius 223. Similar to regions 24, 25, 26, previously described, in this embodiment, cone region 224 is concave, shoulder region 225 is generally convex, and gage region 226 extends substantially parallel to bit axis 211.

Cutting structure 215 includes three primary blades 231, 232, 233 circumferentially spaced-apart about bit axis 211, and three secondary blades 234, 235, 236 circumferentially spaced apart about bit axis 211. In this embodiment, primary blades 231, 232, 233 and secondary blades 234, 235, 236 are circumferentially arranged in an alternating fashion. In this embodiment, the plurality of blades (e.g., primary blades 231, 232, 233 and secondary blades 234, 235, 236) are uniformly angularly spaced on bit face 220 about bit axis 211. Each primary blade 231, 232, 233 includes a cutter-supporting surface 242 for mounting a plurality of cutter elements, and each secondary blade 234, 235, 236 includes a cutter-supporting surface 252 for mounting a plurality of cutter elements.

Referring still to FIG. 14, a plurality of primary cutter elements 240, each having a forward-facing cutting face 244, are mounted to cutter-supporting surface 242, 252 of each primary blade 231, 232, 233 and each secondary blade 234, 235, 236, respectively. Cutter elements 240 are generally arranged adjacent one another in a radially extending row proximal the leading edge of each blade 231-236, relative to the cutting direction of bit 200 represented by arrow 218. Each cutting face 244 has an outermost cutting tip $\mathbf{244}_T$ positioned furthest from cutter-supporting surface 242, 252 to which it is mounted (as measured perpendicularly from its respective cutter-supporting surface 242, 252).

Bit 200 also comprises a plurality of stabilizing members 270 supported by and extending from cutter-supporting surfaces 242, 252. In this embodiment, one stabilizing members 270 is provided on each blade 231-236. Each stabilizing member 270 on a given blade 231-236 trails the row of cutter elements 240 provided on the same blade 231-236.

Figure 17A:
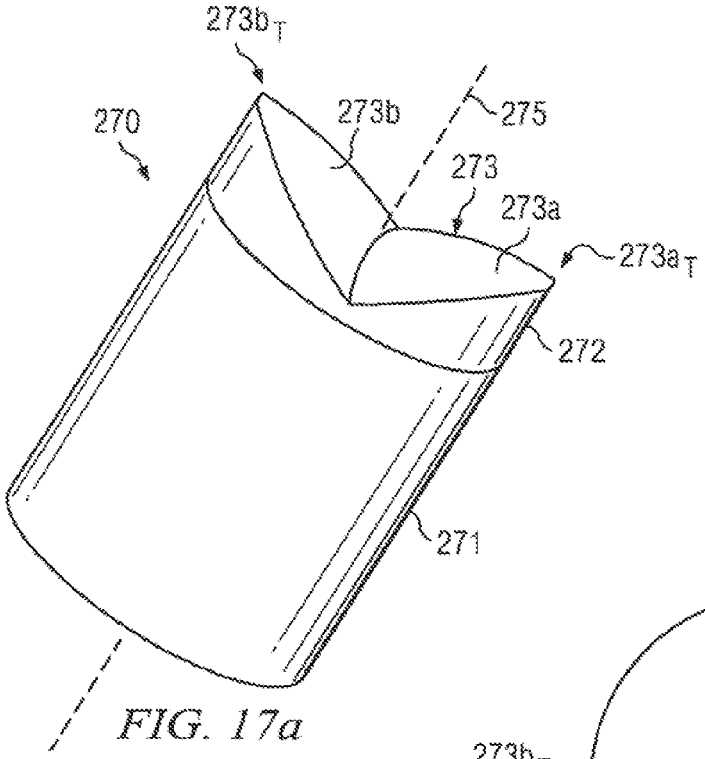
FIGS. 17*a-c* are perspective, side, and top views, respectively, of one of the stabilizing members of FIG. 14.
Figure 17C:
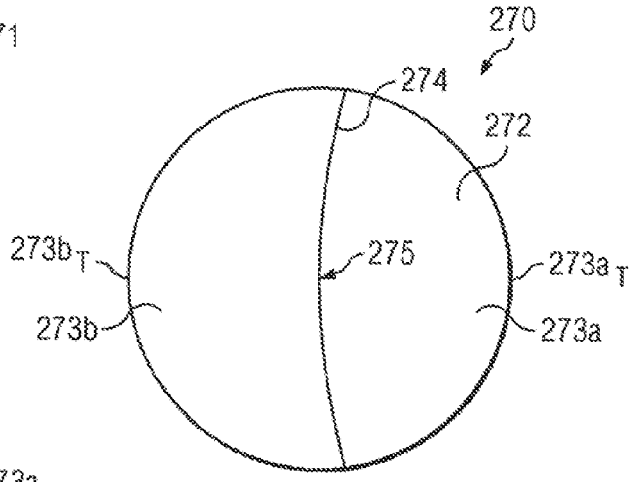
Figure 17B:
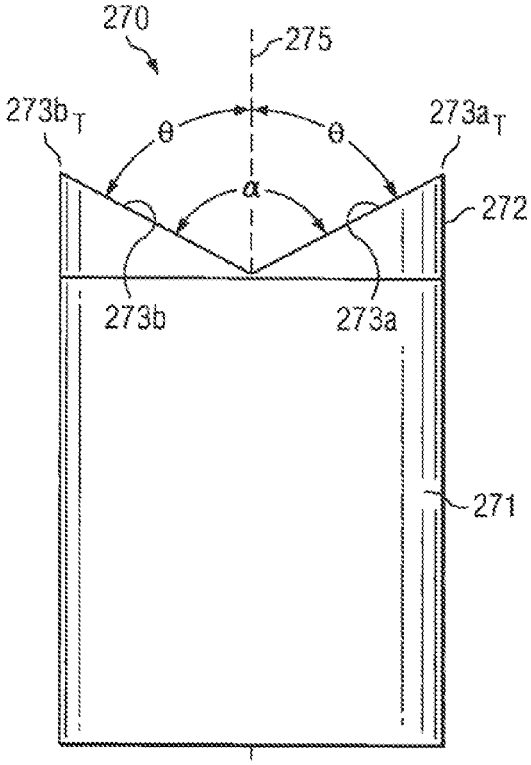

As best shown in FIGS. 17*a-c*, each stabilizing member 270 comprises a generally cylindrical base 271 having a central or longitudinal axis 275, and a formation engaging portion 272 extending from base 271. Formation engaging portion 272 includes a generally concave end 273 distal base 271. In this embodiment, concave end 273 is shaped like an inverted wedge. In particular, concave end 273 includes a first formation-facing surface 273*a* that is generally planar surface, and a second formation-facing surface 273*b* that is generally planar. In other embodiments, one or both formation-facing surfaces (e.g., formation facing surfaces 273*a, b*) may be non-planar.

As best shown in the top view of FIG. 17*c*, in this embodiment, formation-facing surfaces 273*a, b* intersect along a line of intersection 274. As best shown in FIG. 14, each stabilizing member 270 is positioned such that line of intersection 274 is generally aligned with an parallel to arrow 218, which represents the direction of rotation of bit 200. In this embodiment, axis 275 intersects line of intersection 274. In general, line of intersection 274 may be linear (straight) or arcuate (curved). However, line intersection 274 is preferably arcuate in top view. As will be described in more detail below, each stabilizing member 270 is preferably configured such that its line of intersection 274 has a radius of curvature generally equal to the radial distance measured perpendicularly from bit axis 211 to concave end 273 at axis 275. In other words, line of intersection 274 preferably has a radius of curvature in top view equal to the distance measured radially from bit axis 211 to the intersection of axis 275 and concave end 273. As previously described, in this embodiment, axis 275 intersects line of intersection 274 at concave end 273, and thus, the distance measured radially from bit axis 211 to the intersection of axis 275 and concave end 273 is equal to the distance measured radially from bit axis 211 to the intersection of axis 275 and line of intersection 274. For an exemplary stabilizing member 270 oriented such that the distance measured perpendicularly from bit axis 211 to the intersection of axis 275 and concave end 273 is 4.00 inches, its line of intersection 274 preferably has a radius of curvature of 4.00 inches.

Figure 15:
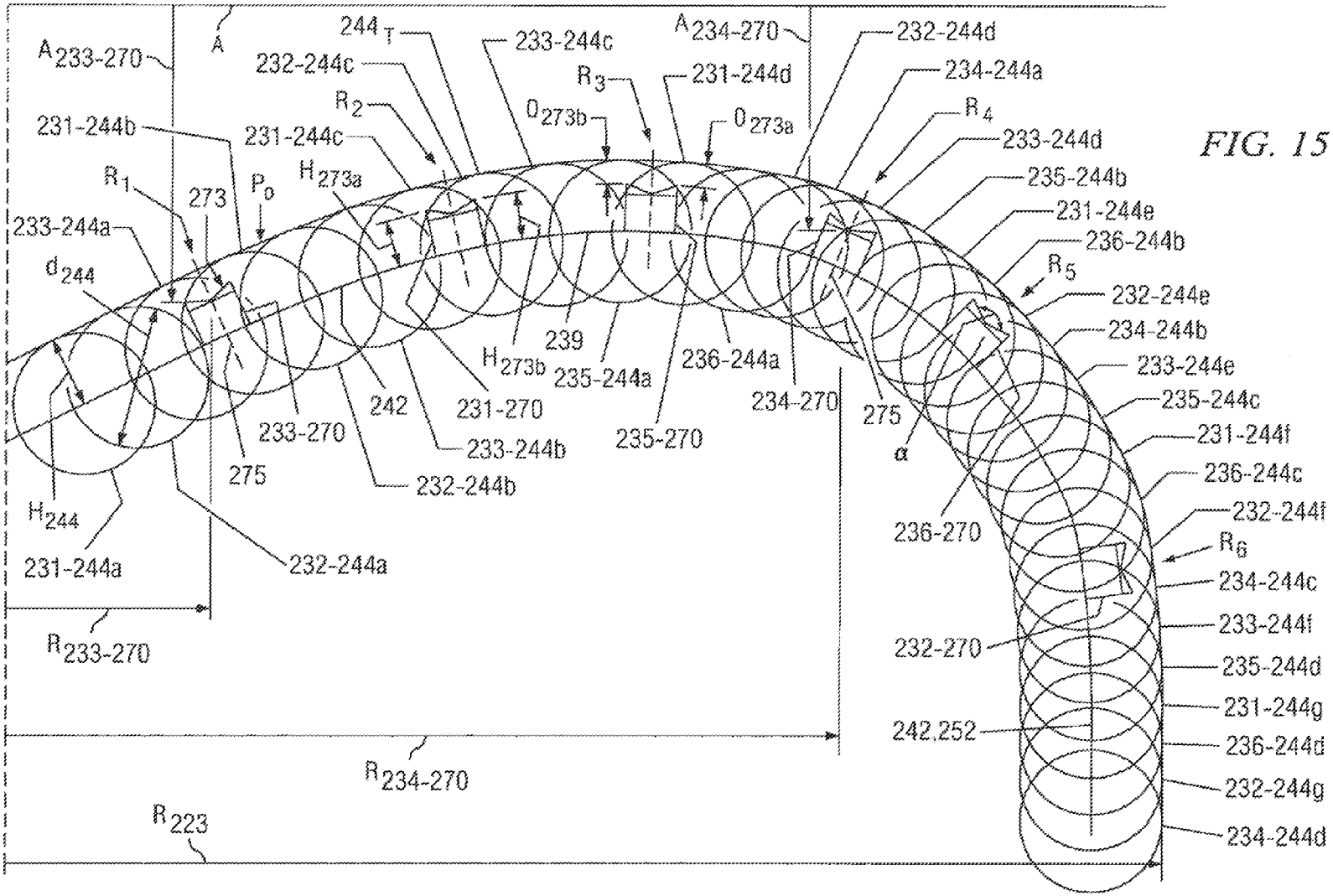
FIG. 15 is a schematic view showing the blades, the cutting faces, and the stabilizing members of FIG. 14 rotated into a single composite rotated profile.
Figure 16:
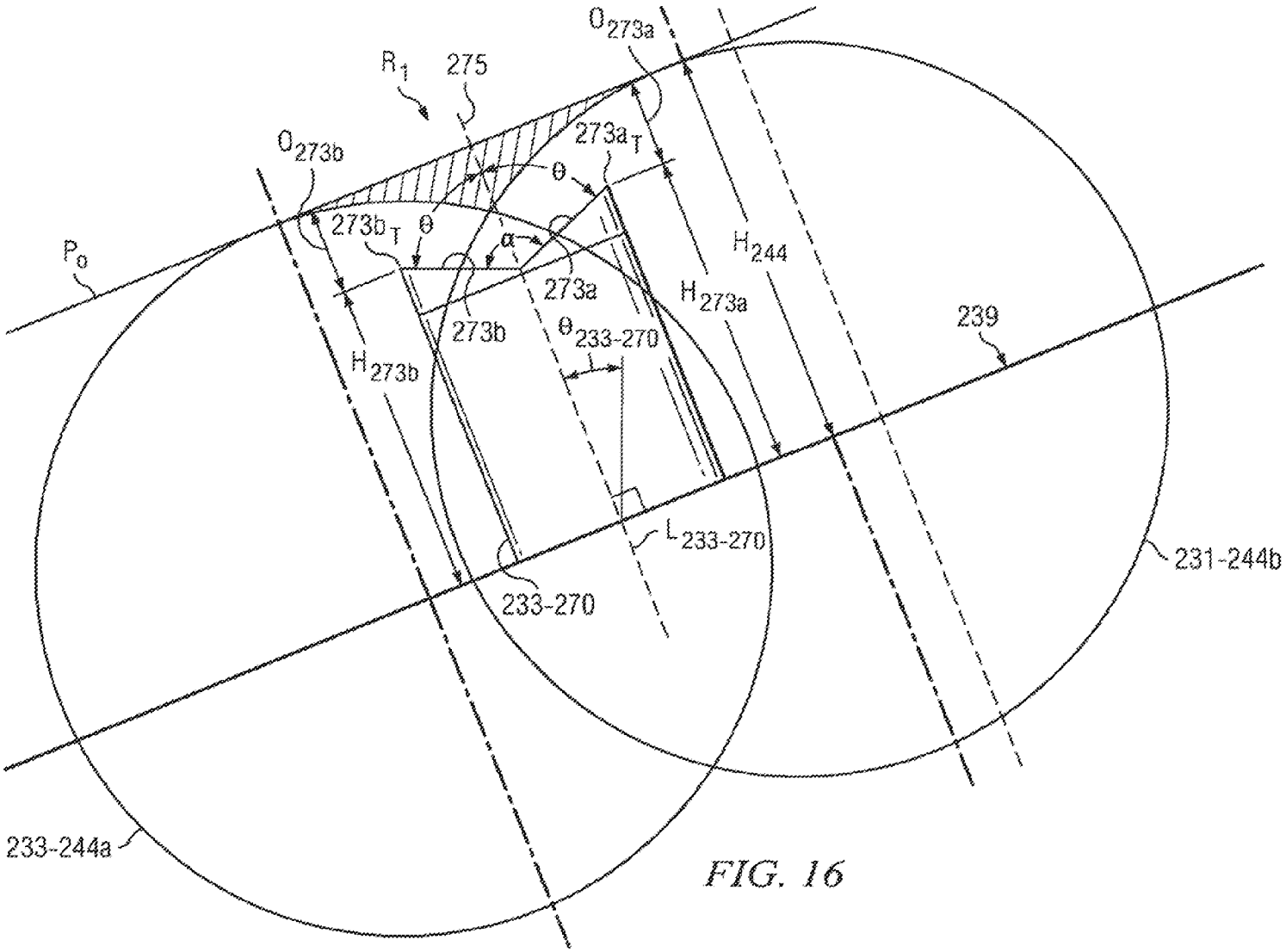
FIG. 16 is an enlarged view of one stabilizing member and associated cutting faces of FIG. 15.

Referring still to FIGS. 17*a-c*, in this embodiment, each formation facing surface 273*a, b* extends between line of intersection 274 and a tip $\mathbf{273}a_T$, $\mathbf{273}b_T$, respectively. In other embodiments, one or more other surfaces may extend between the formation facing surfaces (e.g., formation facing surfaces 273*a, b*) proximal the base (e.g., base 271). Moving radially outward from line of intersection 274 to tips $\mathbf{273}a_T$, $\mathbf{273}b_T$, formation facing surfaces 273*a, b* each extend axially upward and away from base 271 to tips $\mathbf{273}a_T$, $\mathbf{273}b_T$. Thus, tips $\mathbf{273}a_T$, $\mathbf{273}b_T$ are axially further from base 271 (relative to axis 275) than line of intersection 274. In this embodiment, cutting tips $\mathbf{273}a_T$, $\mathbf{273}b_T$ are equidistant from base 271 measured parallel to axis 275. Further, formation-facing surfaces 273*a*, 273*b* are each oriented at an acute angle θ relative to central axis 275 in side view (FIG. 17*b*) and in rotated profile view (FIGS. 15 and 16). Each angle θ is preferably between 5° and 75°, and more preferably between 30° and 60°. Still further, formation-facing surfaces 273*a*, 273*b* are oriented to include an angle α therebetween in side view (FIG. 17*b*) and in rotated profile view (FIGS. 15 and 16). In other words, formation-facing surface 273*a* is oriented at angle α relative to formation-facing surface 273*b* in side view and in rotated profile view. Angle α is generally the sum of each angle θ and is preferably less than 180°, and more preferably between 60° and 120°.

Referring again to FIG. 14, for purposes of clarity and further explanation, moving radially outward from bit axis 211, cutter elements 240 mounted to primary blades 231, 232 are assigned reference numerals 231-240*a-g*, 232-240*a-g*, respectively, there being seven primary cutter elements 240 mounted to each primary blade 231, 232; cutter elements 240 mounted to primary blade 233 are assigned reference numerals 233-240*a-f* there being six primary cutter elements 240 mounted to primary blade 233; and cutter elements 240 mounted to secondary blades 234, 235, 236 are assigned reference numerals 234-240*a-d*, 235-240*a-d*, 236-240*a-d*, respectively, there being four primary cutter elements 240 mounted to each secondary blade 234, 235, 236. In addition, stabilizing members 270 extending from blades 231-236 are assigned reference numerals 231-270, 232-270, 233-270, 234-270, 235-270, 236-270, respectively, there being one stabilizing members on each blade 231-236.

In FIG. 15, the profiles of primary blades 231, 232, 233, secondary blades 234, 235, 236, cutting faces 244, and stabilizing members 270 are schematically shown rotated into a single composite rotated profile view. For purposes of clarity and further explanation, cutting faces 244 of primary cutter elements 231-240*a-g*, 232-240*a-g*, 233-240*a-f*, 234-240*a-d*, 235-240*a-d*, 236-240*a-d* are assigned reference numerals 231-244*a-g*, 232-244*a-g*, 233-244*a-f*, 234-244*a-d*, 235-244*a-d*, 236-244*a-d*, respectively. In FIG. 16, an enlarged rotated profile view of exemplary stabilizing member 233-270 and cutting faces 233-244*a*, 231-244*b* are shown.

Referring now to FIGS. 15 and 16, in rotated profile view, cutter-supporting surface 242, 252 of each blade 231-236 extends along and defines a single composite blade profile 239. In addition, each cutting face 244 (i.e., each cutting face 231-244*a-g*, 232-244*a-g*, 233-244*a-f*, 234-244*a-d*, 235-244*a-d*, 236-244*a-d*) extends to substantially the same extension height $H_{244}$ measured perpendicularly from cutter-supporting surfaces 242, 252 (or blade profile 239). Cutting tips $\mathbf{244}_T$ of cutting faces 244 are each disposed at extension height $H_{244}$ and define an outermost cutting profile $P_o$ that extends radially from bit axis 211 to outer radius 223.

Referring still to FIGS. 15 and 16, each stabilizing member 231-270, 232-270, 233-270, 234-270, 235-270, 236-270 is oriented such that its axis 275 is oriented generally perpendicular to cutter-supporting surface 242, 252. Consequently, each central axis 275 is perpendicular to blade profile 239 in rotated profile view. Each tip $\mathbf{274}a_T$, $\mathbf{273}b_T$ of each stabilizing member 231-270, 232-270, 233-270, 234-270, 235-270, 236-270 has an extension height $H_{273a}$, $H_{273b}$, respectively, measured perpendicularly from composite blade profile 239 (cutter supporting surfaces 242, 252) to tip $\mathbf{273}a_T$, $\mathbf{273}b_T$, respectively. In this embodiment, extension height $H_{273a}$, $H_{273b}$ of each tip $\mathbf{273}a_T$, $\mathbf{273}b_T$ is substantially the same. Further, in this embodiment, extension height $H_{273a}$, $H_{273b}$ of each tip $\mathbf{273}a_T$, $\mathbf{273}b_T$ is less than extension height $H_{244}$. Thus, as best shown in FIG. 16, each tip $\mathbf{273}a_T$, $\mathbf{273}b_T$ is offset from the outermost composite cutting profile $P_o$ by a composite cutting profile offset distance $O_{273a}$, $O_{273b}$, respectively, equal to the shortest distance between each tip $\mathbf{273}a_T$, $\mathbf{273}b_T$ and outermost composite cutting profile $P_o$. In this embodiment, composite cutting profile offset distance $O_{273a}$, $O_{273b}$ of each tip $\mathbf{273}a_T$, $\mathbf{273}b_T$, respectively, is substantially the same, and is generally equal to the difference between extension height $H_{244}$ and extension heights $H_{273a}$, $H_{273b}$, respectively. Composite cutting profile offset distance $O_{273a}$, $O_{273b}$ is preferably between 0.020 in. (~0.508 mm) and 0.100 in. (~2.54 mm), and more preferably between 0.040 in. (~1.016 mm) and 0.060 in. (~1.524 mm).

In this embodiment, each cutter element 240 has substantially the same cylindrical geometry and size. Consequently, each cutting face 244 has substantially the same diameter $d_{244}$. Diameter $d_{244}$ of each cutting face 244 is preferably between about 13 mm (~0.512 in.) and 19 mm (~0.748 in.). Further, in this embodiment, each stabilizing member 270 has substantially the same cylindrical geometry and size. For most applications and bit sizes, stabilizing members 270 preferably have a diameter between about 0.433 in. (~11 mm) and about 0.748 in. (~19 mm), and more preferably between about 0.512 in. (~13 mm) and about 0.63 in. (~16 mm).

As a result of the relative sizes and radial positions cutting faces 244 and stabilizing members 270, each stabilizing member 270 is substantially eclipsed by two or more adjacent cutting faces 244 in rotated profile view. For example, stabilizing member 233-270 is substantially eclipsed by cutting face 233-244*a* and cutting face 231-244*b*; stabilizing member 231-270 is substantially eclipsed by cutting face 231-244*c* and cutting face 232-244*c*; stabilizing member 235-270 is substantially eclipsed by cutting face 235-244*a* and cutting face 231-244*d*; stabilizing member 234-270 is substantially eclipsed by cutting face 234-244*a* and cutting face 233-244*d*; and stabilizing member 236-270 is substantially eclipsed by cutting face 236-244*b* and cutting face 232-244*e*. Further, in this embodiment, three stabilizing member 270 are completely eclipsed by a single cutting face 244. In particular, stabilizing member 234-270 is completely eclipsed by both cutting face 234-244*a* and cutting face 233-244*d*, stabilizing member 236-270 is completely eclipsed by both cutting face 236-244*b* and cutting face 232-244*e*, and stabilizing member 232-270 is completely eclipsed by both cutting face 232-244*f* and cutting face 234-244*c*. In other embodiments, one or more stabilizing members (e.g., stabilizing members 270) and/or one or more cutting faces (e.g., cutting faces 244) may be sized and positioned such that each stabilizing member is completely eclipsed by one or more cutting faces (e.g., cutting faces 244) in rotated profile view or such that no stabilizing member is completely eclipsed by any cutting face.

As best shown in FIG. 15, in this embodiment, each cutter element 240 and its associated cutting face 244 is disposed at a different and unique radial position (relative to bit axis 211) and/or axial position (relative to a reference plane that is perpendicular to bit axis 211) in rotated profile view. In cone and shoulder regions 224, 225, each cutter element 240 and its associated cutting face 244 is disposed at a different and unique radial position relative to bit axis 211 in rotated profile view. However, in gage region 226, multiple cutter elements 240 and their associated cutting faces 244 may be disposed at similar radial positions. In cone and shoulder regions 224, 225, one or more pair of cutter elements 240 and their associated cutting faces 244 may be disposed at the same axial position relative to a reference plane that is perpendicular to bit axis 211 in rotated profile view. However, in gage region 226, each cutter element 240 and its associated cutting face 244 is disposed at a different and unique axial position. Thus, no two cutter elements 240 or cutting faces 244 are disposed at the same radial position relative to bit axis 211 and the same axial position relative to a reference plane that is perpendicular to bit axis 211. Although cutting faces 244 are disposed in different radial positions and/or axial positions, due to their relative sizes and positions, each cutting face 244 at least partially overlap with one or more other cutting faces 244 in rotated profile view. In other words, each cutting face 244 is eclipsed by at least one other cutting face 244 in rotated profile view. In this manner, cutting faces 244 are positioned and arranged to enhance bottomhole coverage.

In this embodiment, each stabilizing member 270 is also disposed at a different and unique radial position (relative to bit axis 211) and/or axial position (relative to a reference plane that is perpendicular to bit axis 211) in rotated profile view. As previously described, the "radial position" of a stabilizing member with a convex formation-facing end (e.g., stabilizing member 70 with convex end 72) is defined by the radial distance measured perpendicularly from the bit axis to the bearing tip of the stabilizing member. However, stabilizing members 270 include a concave formation-facing end 273. The "radial position" of a stabilizing member with a concave formation-facing end is defined by the radial distance measured perpendicularly from the bit axis to the intersection of the central axis of the stabilizing member at the concave end (e.g., concave end 273). As previously described, each stabilizing member 270 has a central axis 275 and a concave formation-facing end 273. Thus, the radial position of each stabilizing member 270 with concave end 273 is defined by the radial distance measured perpendicularly from bit axis 211 to the intersection of central axis 275 and concave end 273. For example, as shown in FIG. 15, the radial position of stabilizing member 233-270 is defined by a radial distance $R_{233\text{-}270}$ measured perpendicularly from bit axis 211 to the intersection of axis 275 and concave end 273 of stabilizing member 233-270. As another example, the radial position of stabilizing member 234-270 is defined by a radial distance $R_{234\text{-}270}$ measured perpendicularly from bit axis 211 to the intersection of axis 275 and concave end 273 of stabilizing member 234-270.

Further, the "axial position" of a stabilizing member with a concave formation-facing end is defined by the axial distance measured perpendicularly from a reference plane perpendicular to the bit axis to the intersection of the central axis of the stabilizing member at the concave end (e.g., concave end 273). Thus, the axial position of each stabilizing member 270 with concave end 273 is defined by the axial distance measured from a reference plane perpendicular to bit axis 211 to the intersection of central axis 275 and concave end 273. For example, as shown in FIG. 15, the axial position of stabilizing member 233-270 is defined by an axial distance $A_{233\text{-}270}$ measured perpendicularly from a reference plane A (parallel to bit axis 211) to the intersection of axis 275 and concave end 273 of stabilizing member 233-270. As another example, the axial position of stabilizing member 234-270 is defined by an axial distance $A_{234\text{-}270}$ measured perpendicularly from reference plane A (parallel to bit axis 211) to the intersection of axis 275 and concave end 273 of stabilizing member 234-270.

In this embodiment, each stabilizing member 231-270, 232-270, 233-270, 234-270, 235-270, 236-270 is disposed at a different and unique radial position (relative to bit axis 111) and/or axial position (relative to a reference plane that is perpendicular to bit axis 111) in rotated profile view.

Referring still to FIGS. 15 and 16, as previously described, the position and orientation of each cutting face and each stabilizing member may also be described in terms of a "profile angle line" that bisects the cutting face/stabilizing member in rotated profile view, and a "profile angle." The profile angle line of a cutting face bisects the cutting face and is perpendicular to the outermost cutting profile $P_o$ in rotated profile view, and the "profile angle line" of a stabilizing member refers to a line extending along the central axis of the stabilizing member. For example, as shown in FIG. 16, a profile angle line $L_{233\text{-}270}$ extends along central axis 275 of stabilizing member 233-270 in rotated profile view; profile angle line $L_{233-270}$ is oriented at a profile angle $\theta_{233-270}$ measured between the bit axis (or a line parallel to the bit axis) and profile angle line $L_{233-270}$ in rotated profile view. In this embodiment, each stabilizing member 270 is disposed at a unique profile angle in cone and shoulder regions 224, 225, and each cutting face 244 is disposed at a unique profile angle in cone and shoulder regions 224, 225.

Similar to stabilizing members 70, 170 previously described, stabilizing members 270 offer the potential to enhance bit stability, as well as limit the maximum depth-of-cut of cutting faces 244 as they engage the formation. Concave end 273 and formation-facing surfaces 273*a, b* of each stabilizing member 270 generally face away from the cutter-supporting surface 242, 252 to which stabilizing member 270 is mounted and are adapted to engage and slide across a ridge of uncut formation. In particular, formation-facing surfaces 273*a, b* of each stabilizing member 270 are positioned and oriented to engage opposite sides of the ridge of uncut formation defined by the kerfs created by a pair of cutting faces 244 that are (a) on circumferentally adjacent blades 231-236, and (b) adjacent one another in rotated profile view. Referring specifically to FIGS. 14 and 15, cutting faces 233-244*a*, 231-244*b* are mounted to circumferentially adjacent blades 231, 233 (circumferentially adjacent in cone region 224) and are adjacent one another in rotated profile view; cutting faces 231-244*c*, 232-244*c* are mounted to circumferentially adjacent blades 231, 232 and are adjacent one another in rotated profile view; cutting faces 235-244*a*, 231-244*d* are mounted to circumferentially adjacent blades 231, 235 and are adjacent one another in rotated profile view; cutting faces 234-244*a*, 233-244*d* are mounted to circumferentially adjacent blades 234, 233 and are adjacent one another in rotated profile view; cutting faces 236-244*b*, 232-244*e* are mounted to circumferentially adjacent blades 236, 232 and are adjacent one another in rotated profile view; and cutting faces 232-244*f*, 234-244*c* are mounted to circumferentially adjacent blades 232, 234 and are adjacent one another in rotated profile view.

As best shown in FIGS. 15 and 16, the kerfs formed by cutting faces 233-244*a*, 231-244*b* define a ridge $R_1$ of uncut formation. Likewise, the kerfs formed by cutting faces 231-244*c*, 232-244*c* define a ridge $R_2$ of uncut formation; the kerfs formed by cutting faces 235-244*a*, 231-244*d* define a ridge $R_3$ of uncut formation; the kerfs formed by cutting faces 234-244*a*, 233-244*d* define a ridge $R_4$ of uncut formation; the kerfs formed by cutting faces 236-244*b*, 232-244*e* define a ridge $R_5$ of uncut formation; and the kerfs formed by cutting faces 232-244*f*, 234-244*c* define a ridge $R_6$ of uncut formation. Concave end 273 and formation-facing surfaces 273*a, b* of stabilizing members 233-270, 231-270, 235-270, 234-270, 236-270, 232-270 are adapted to engage and ride along ridges $R_1$, $R_2$, $R_3$, $R_4$, $R_5$, $R_6$, respectively, at a sufficient depth-of-cut. The stabilizing members are not intended to penetrate and shear the formation, but rather, contact and slide across the formation, thereby limiting a further increase in the depth-of-cut of the cutting faces.

In this embodiment of bit 200, stabilizing members 270 are generally arranged such that formation-facing surfaces 273*a, b* are positioned to engage opposite sides of the same ridge. For example, as best shown in FIG. 15, formation-facing surfaces 273*a, b* of stabilizing member 233-270 are positioned to engage opposite sides of ridge $R_1$ at a sufficient depth of cut; formation-facing surfaces 273*a, b* of stabilizing member 231-270 are positioned to engage opposite sides of ridge $R_2$ at a sufficient depth of cut; formation-facing surfaces 273*a, b* of stabilizing member 235-270 are positioned to engage opposite sides of ridge $R_3$ at a sufficient depth of cut; formation-facing surfaces 273*a, b* of stabilizing member 234-270 are positioned to engage opposite sides of ridge $R_4$ at a sufficient depth of cut; formation-facing surfaces 273*a, b* of stabilizing member 236-270 are positioned to engage opposite sides of ridge $R_5$ at a sufficient depth of cut; and formation-facing surfaces 273*a, b* of stabilizing member 232-270 are positioned to engage opposite sides of ridge $R_6$ at a sufficient depth of cut.

By limiting the depth-of-cut, the stabilizing members described herein offer the potential to reduce problems associated with excessive depths-of-cut such as excessive wear and damage to cutting faces during transitions from soft to hard formation and bit balling. Further, stabilizing members also offer the potential to enhance bit stability and reduce bit vibrations during drilling. Specifically, as the bearing ends of the stabilizing members engage the ridges defined by the kerfs of their corresponding cutting faces, they restrict lateral movement of the bit within the borehole.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A drill bit for drilling a borehole in an earthen formation, the bit comprising:

a bit body having a bit axis, a bit face, and a direction of rotation about the bit axis, wherein the bit face includes a cone region, a shoulder region, and a gage region;

a first blade having a cutter-supporting surface and extending radially along the bit face;

a plurality of primary cutter elements mounted to the cutter-supporting surface of the first blade, each primary cutter element on the first blade being mounted in a different radial position relative to the bit axis in the cone region and the shoulder region, and wherein each primary cutter element has a cutting face that is forward-facing relative to the direction of rotation, wherein each cutting face defines a cutting profile in rotated profile view, wherein the cutting profiles of the plurality of cutting faces define an outermost cutting profile $P_o$ in rotated profile view; and a first stabilizing member mounted to the cutter-supporting surface of the first blade, the first stabilizing member having a longitudinal axis and a concave end distal the cutter-supporting surface of the first blade;

wherein the concave end of the first stabilizing member includes a first formation-facing surface extending to a first tip distal the cutter-supporting surface and a second formation-facing surface extending to a second tip distal the cutter-supporting surface, wherein the first formation-facing surface intersects the second formation-facing surface, and wherein the first formation-facing surface extends from the second formation-facing surface to the first tip and the second formation-facing surface extends from the first formation-facing surface to the second tip, and wherein the first tip and the second tip are each offset from the outermost cutting profile $P_o$ in rotated profile view.

2. The drill bit of claim 1, wherein the first formation-facing surface and the second formation-facing surface being disposed on opposite sides of the longitudinal axis in rotated profile view.

3. The drill bit of claim 1, wherein the first tip is offset from the outermost cutting profile by a first composite cutting profile offset distance, and the second tip is offset from the outermost cutting profile by a second composite cutting profile offset distance, wherein the first composite cutting profile offset distance and the second composite cutting profile offset distance are each less than 0.100 in.

4. The drill bit of claim 3, wherein the first composite cutting profile offset distance and the second composite cutting profile offset distance are each between 0.040 in. and 0.060 in.

5. The drill bit of claim 1, wherein the first formation-facing surface is oriented at an acute angle $\theta_1$ relative to the longitudinal axis in rotated profile view and the second formation-facing surface is oriented at an acute angle $\theta_2$ relative to the longitudinal axis in rotated profile view.

6. The drill bit of claim 5, wherein angle $\theta_1$ and angle $\theta_2$ are each between 30° and 60°.

7. The drill bit of claim 5, wherein the first formation-facing surface is generally planar, the second formation-facing surface is generally planar, and the first formation-facing surface intersects the second formation-facing surface at a line of intersection.

8. The drill bit of claim 7, wherein the line of intersection is arcuate in top view.

9. The drill bit of claim 8, wherein the line of intersection intersects the longitudinal axis and has a radius of curvature in top view that is equal to the distance measured perpendicularly from the bit axis to the intersection of the longitudinal axis and the line of intersection.

10. The drill bit of claim 1, wherein;

the first blade is a primary blade extending radially along the bit face from the cone region to the gage region; and the first stabilizing member is mounted to the cutter-supporting surface of the first blade in the cone region or the shoulder region.

11. A method of drilling a borehole in an earthen formation comprising:

(a) providing a drill bit comprising:

a bit body having a bit axis, a bit face, and a direction of rotation about the bit axis;

a plurality of blades extending radially along the bit face, each blade including a cutter-supporting surface;

a plurality of cutter elements mounted to the cutter-supporting surface of each blade, wherein each cutter element has a cutting face that is forward-facing relative to the direction of rotation;

wherein each cutting face defines a cutting profile in rotated profile view, and wherein the plurality of cutting faces define a composite cutting profile in rotated profile view; and a stabilizing member mounted to the cutter-supporting surface of a first blade of the plurality of blades, the stabilizing member having a longitudinal axis and a concave end distal the cutter-supporting surface of the first blade, wherein the concave end of the first stabilizing member includes a first formation-facing surface and a second formation-facing surface, and wherein the first formation-facing surface is planar and intersects the second formation-facing surface;

(b) engaging the formation with the drill bit after (a);

(c) penetrating the formation with a first of the plurality of cutter elements and a second of the plurality of cutter elements to a depth-of-cut; and (d) limiting the depth of cut with the stabilizing member.

12. The method of claim 11, wherein the first formation-facing surface and the second formation-facing surface being disposed on opposite sides of the longitudinal axis in rotated profile view.

13. The method of claim 11 further comprising:

(e) forming a ridge of uncut formation between the first and the second of the plurality of cutter elements, wherein the first of the plurality of cutter elements and the second of the plurality of cutter elements are disposed on different blades, and wherein the cutting profile of the cutting face of the first of the plurality of cutter elements is immediately adjacent the cutting profile of the cutting face of the second of the plurality of cutter elements in rotated profile view; and (f) engaging the ridge of uncut formation with the concave end of the stabilizing member.

14. The method of claim 13, wherein the ridge of uncut formation includes a first side and a second side in rotated profile view, wherein the first side is defined by a kerf cut by the first of the plurality of cutter elements and the second side is defined by a kerf cut by the second of the plurality of cutter elements;

wherein (f) comprises engaging the first side of the ridge with the first formation-facing surface of the stabilizing member and engaging the second side of the ridge with the second formation-facing surface of the stabilizing member.

15. The method of claim 14 wherein the first formation-facing surface extends to a first tip distal the cutter-supporting surface and the second formation facing surface extends to a second tip distal the cutter-supporting surface;

wherein the first tip and the second tip are each offset from the outermost cutting profile $P_o$ in rotated profile view.

16. The method of claim 15, wherein the first formation-facing surface intersects the second formation-facing surface, and wherein the first formation-facing surface extends from the second formation-facing surface to a first tip distal the cutter-supporting surface and the second formation-facing surface extends from the first formation-facing surface to a second tip distal the cutter-supporting surface.

17. The method of claim 15, wherein the first tip is offset from the outermost cutting profile by a first composite cutting profile offset distance, and the second tip is offset from the outermost cutting profile by a second composite cutting profile offset distance, wherein the first composite cutting profile offset distance and the second composite cutting profile offset distance are each less than 0.100 in.

18. A drill bit for drilling a borehole in an earthen formation, the bit comprising:

a bit body having a bit axis, a bit face, and a direction of rotation about the bit axis, wherein the bit face includes a cone region, a shoulder region, and a gage region;

a first blade having a cutter-supporting surface and extending radially along the bit face;

a plurality of primary cutter elements mounted to the cutter-supporting surface of the first blade, each primary cutter element on the first blade being mounted in a different radial position relative to the bit axis in the cone region and the shoulder region, and wherein each primary cutter element has a cutting face that is forward-facing relative to the direction of rotation, each cutting face defining a cutting profile in rotated profile view, the cutting profiles of the plurality of cutting faces defining an outermost cutting profile $P_o$ in rotated profile view; and a first stabilizing member mounted to the cutter-supporting surface of the first blade, the first stabilizing member having a longitudinal axis and a concave end distal the cutter-supporting surface of the first blade, wherein the concave end of the first stabilizing member includes a first formation-facing surface extending to a first tip distal the cutter-supporting surface and a second formation-facing surface extending to a second tip distal the cutter-supporting surface and at least one of the first tip and second tip being a radially outermost point on the concave end relative to the longitudinal axis, and wherein the first tip and the second tip are each offset from the outermost cutting profile $P_o$ in rotated profile view.

19. The drill bit of claim 18, wherein the first formation facing surface is substantially planar.

20. The drill bit of claim 18, further comprising one or more surfaces extending between the first formation facing surface and the second formation facing surface.

* * * * *